US011808134B2

(12) United States Patent
Wicks et al.

(10) Patent No.: US 11,808,134 B2
(45) Date of Patent: Nov. 7, 2023

(54) USING HIGH RATE TELEMETRY TO IMPROVE DRILLING OPERATIONS

(71) Applicant: Schlumberger Technology Corporation, Sugar Land, TX (US)

(72) Inventors: Nathaniel Wicks, Somerville, MA (US); Joergen Johnsen, Houston, TX (US); Rui Pan, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 530 days.

(21) Appl. No.: 16/834,671

(22) Filed: Mar. 30, 2020

(65) Prior Publication Data

US 2021/0301642 A1 Sep. 30, 2021

(51) Int. Cl.

| | |
|---|---|
| ***E21B 44/04*** | (2006.01) |
| ***E21B 47/12*** | (2012.01) |
| ***E21B 7/04*** | (2006.01) |
| ***E21B 19/00*** | (2006.01) |
| ***E21B 4/02*** | (2006.01) |
| ***E21B 47/024*** | (2006.01) |
| ***E21B 21/08*** | (2006.01) |
| ***E21B 3/02*** | (2006.01) |

(52) U.S. Cl.

CPC ..... *E21B 44/04* (2013.01); *E21B 3/022* (2020.05); *E21B 4/02* (2013.01); *E21B 7/04* (2013.01); *E21B 19/008* (2013.01); *E21B 21/08* (2013.01); *E21B 47/024* (2013.01); *E21B 47/12* (2013.01)

(58) Field of Classification Search

CPC . E21B 44/04; E21B 3/022; E21B 4/02; E21B 7/04; E21B 19/008; E21B 21/08; E21B 47/024; E21B 47/12

See application file for complete search history.

(56) References Cited

U.S. PATENT DOCUMENTS 6,050,348 A 4/2000 Richarson et al.
6,802,378 B2 10/2004 Haci et al.

(Continued)

FOREIGN PATENT DOCUMENTS

EP 1915504 B1 6/2010
WO 2014066368 A2 5/2014

OTHER PUBLICATIONS

Search Report and Written Opinion of International Patent Application No. PCT/US2021/024571 dated Jul. 5, 2021; 13 pages.

(Continued)

*Primary Examiner* — Dany E Akakpo
(74) *Attorney, Agent, or Firm* — Jeffrey D. Frantz

(57) ABSTRACT

Systems and methods for using high rate telemetry to improve drilling operations. A method may include performing drilling operations with a wired drill pipe (WDP) string in an oil and/or gas well. The drilling operations may include pumping drilling fluid to a mud motor of the WDP string through an internal passage of the WDP string and vertically moving the WDP string via a drawworks while controlling the drawworks to change speed of the WDP string based on downhole data received by wellsite surface equipment via electrical conductors integral to WDP of the WDP string. The received downhole data may include downhole pressure data that is generated downhole by a pressure sensor and is indicative of pressure of the drilling fluid in the internal passage.

20 Claims, 6 Drawing Sheets

(56) References Cited

U.S. PATENT DOCUMENTS

| | | | | |
|---|---|---|---|---|
| 7,775,297 | B2 | 8/2010 | Hopwood et al. | |
| 8,360,171 | B2 | 1/2013 | Boone et al. | |
| 9,803,473 | B2 | 10/2017 | Orban et al. | |
| 10,054,917 | B2 | 8/2018 | Penn et al. | |
| 10,094,209 | B2 | 10/2018 | Gillan et al. | |
| 10,370,960 | B2 | 8/2019 | Orban | |
| 2003/0234119 | A1* | 12/2003 | Ray | E21B 44/02 175/27 |
| 2016/0047219 | A1 | 2/2016 | Jeffryes | |
| 2016/0090800 | A1 | 3/2016 | Jeffryes | |
| 2016/0145993 | A1 | 5/2016 | Gillan et al. | |
| 2016/0237760 | A1* | 8/2016 | Wall | E21B 17/028 |
| 2017/0241253 | A1* | 8/2017 | Chapman | E21B 47/024 |
| 2017/0370151 | A1 | 12/2017 | Banirazi-Motlagh et al. | |
| 2018/0128093 | A1 | 5/2018 | Jeffryes et al. | |
| 2018/0135402 | A1 | 5/2018 | Jeffryes et al. | |
| 2019/0178073 | A1* | 6/2019 | Boone | E21B 3/022 |
| 2019/0301273 | A1 | 10/2019 | Gillan | |

OTHER PUBLICATIONS

International Preliminary Report on Patentability of International Patent Application No. PCT/US2021/024571 dated Oct. 13, 2022, 7 pages.

* cited by examiner

USING HIGH RATE TELEMETRY TO IMPROVE DRILLING OPERATIONS

BACKGROUND OF THE DISCLOSURE

Wells are generally drilled into the ground or ocean bed to recover natural deposits of oil, gas, and other materials that are trapped in subterranean rock formations. Well construction (e.g., drilling) operations may be performed at a wellsite by a well construction system (e.g., a drilling rig) having various surface and subterranean well construction equipment (e.g., rig equipment) operating in a coordinated manner. For example, a drive mechanism, such as a top drive located at a wellsite surface, can be utilized to rotate and advance a drill string into a subterranean rock formation to drill a wellbore. The drill string may include a plurality of drill pipes coupled together and terminating with a drill bit. Length of the drill string may be increased by adding additional drill pipes while depth of the wellbore increases. Drilling fluid may be pumped from the wellsite surface down through the drill string to the drill bit. The drilling fluid lubricates and cools the drill bit, and carries drill cuttings from the wellbore back to the wellsite surface. The drilling fluid returning to the surface may then be cleaned and again pumped through the drill string.

The well construction equipment is typically monitored and controlled by rig personnel (e.g., a human equipment operator, such as a driller) from a control center. A typical control center houses a control workstation operable to receive sensor data from various sensors associated with the well construction equipment to permit monitoring of the well construction equipment. The control workstation also facilitates manual control of the well construction equipment by the rig personnel.

The well construction equipment may be grouped into various subsystems, wherein each subsystem performs a different operation, which may be monitored and controlled by a corresponding local equipment controller. Each local equipment controller is typically implemented as a standalone equipment controller operable to execute processes associated with the corresponding subsystem. Although the well construction equipment may operate in a coordinated manner, there is little or no communication between the subsystems and the local equipment controllers, whereby coordination and/or interactions between the subsystems are typically initiated, monitored, and controlled by the rig personnel. However, relying on rig personnel to manually coordinate the well construction operations, monitor the well construction operations for abnormal conditions and events, and control the well construction equipment in response to such abnormal conditions and events limits speed, efficiency, and safety of the well construction operations.

During well construction operations, downhole telemetry (e.g., mud-pulse telemetry, electromagnetic telemetry) may be utilized to communicate downhole sensor data between a bottom-hole assembly (BHA) of a drill string and surface equipment, including the control workstation. Mud-pulse telemetry transmits downhole sensor data between the surface equipment and the BHA in the form of modulated pressure pulses generated by a downhole transmitter. The pressure pulses propagate to a surface receiver (i.e., a pressure sensor) through the drilling fluid transferred downhole through the drill string. Conversely, electromagnetic telemetry transmits downhole data between the surface equipment and the BHA in the form of modulated electromagnetic waves generated by a downhole transmitter. The electromagnetic waves propagate to a surface receiver (i.e., an electromagnetic probe) through the rock formation extending between the downhole transmitter and the surface receiver. However, transmission rate for mud-pulse telemetry and electromagnetic telemetry is very slow, often taking between about 30 to 60 seconds for the downhole sensor data to reach the wellsite surface to be analyzed by an equipment controller and/or the rig personnel via the control workstation. Such slow telemetry transmission rates prevent fast control of downhole equipment from the wellsite surface and result in delayed detection and mitigation of abnormal downhole events.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method that includes performing slide drilling operations with a wired drill pipe (WDP) string in an oil and/or gas well, including imparting rotational oscillations to the WDP string by controlling a top drive based on downhole data received by wellsite surface equipment via electrical conductors integral to WDP of the WDP string. The received downhole data includes downhole rotational orientation data that is generated by rotation sensors distributed axially along the WDP string and is indicative of rotational orientation of different sections of the WDP string.

The present disclosure also introduces a method that includes performing drilling operations with a WDP string in an oil and/or gas well, including pumping drilling fluid to a mud motor of the WDP string through an internal passage of the WDP string and vertically moving the WDP string via a drawworks while controlling the drawworks to change the speed of the WDP string based on downhole data received by wellsite surface equipment via electrical conductors integral to WDP of the WDP string. The received downhole data includes downhole pressure data that is generated downhole by a pressure sensor and is indicative of pressure of the drilling fluid in the internal passage.

The present disclosure also introduces a method that includes performing slide drilling operations with a WDP string in an oil and/or gas well, including imparting rotational oscillations to the WDP string by controlling a top drive based on: (A) downhole rotational orientation data that is: (i) generated by rotation sensors distributed axially along the WDP string; (ii) indicative of rotational orientation of different first sections of the WDP string; and (iii) received by wellsite surface equipment via electrical conductors integral to WDP of the WDP string; and (B) a mathematical model of a downhole system generated by the wellsite surface equipment based at least partially on the received downhole rotational orientation data and downhole torque data that is: (i) generated by torque sensors distributed axially along the WDP string; (ii) indicative of torque transmitted through the different first sections and/or different second sections of the WDP string; and (iii) received by the wellsite surface equipment via the electrical conductors.

The present disclosure also introduces a method that includes performing drilling operations with a WDP string in an oil and/or gas well, including vertically moving the WDP string by controlling a drawworks based on downhole data received by wellsite surface equipment via electrical conductors integral to WDP of the WDP string. The received downhole data includes downhole axial load data that is generated downhole by an axial load sensor and is indicative of axial load applied to a drill bit of the WDP string.

The present disclosure also introduces a method that includes performing drilling operations in an oil and/or gas well with a WDP string that is experiencing stick-slip, including reducing the stick-slip by controlling a top drive based on downhole data received by wellsite surface equipment via electrical conductors integral to WDP of the WDP string. The received downhole data includes downhole rotational speed data that is generated by rotation sensors distributed axially along the WDP string and is indicative of rotational speed of different sections of the WDP string.

The present disclosure also introduces a method that includes performing drilling operations with a WDP string in an oil and/or gas well, including pumping drilling fluid through an internal passage of the WDP string by controlling mud pumps based on downhole data received by wellsite surface equipment via electrical conductors integral to WDP of the WDP string. The received downhole data includes wellbore pressure data that is generated by pressure sensors distributed axially along the WDP string and is indicative of pressure of wellbore fluid outside the WDP string. Controlling the mud pumps maintains the wellbore fluid outside the WDP string at an intended pressure.

The present disclosure also introduces a method that includes performing drilling operations with a WDP string in an oil and/or gas well, including controlling drilling equipment to control the drilling operations based on: (A) downhole data received by wellsite surface equipment via electrical conductors integral to WDP of the WDP string; and (B) a mathematical model of a downhole system. The received downhole data is indicative of downhole properties and is generated by sensors distributed axially along the WDP string. The model is generated by a processing system of the wellsite surface equipment based at least partially on the received downhole data.

The present disclosure also introduces a method that includes performing drilling operations with a WDP string in an oil and/or gas well, including: (A) pumping drilling fluid through an internal passage of the WDP string while wellsite surface equipment receives downhole data via electrical conductors integral to WDP of the WDP string, the received downhole data including downhole pressure data that is: (i) generated by pressure sensors distributed axially along the WDP string; and (ii) indicative of pressure of the drilling fluid surrounding the WDP string in the well; and (B) operating a processing device of the wellsite surface equipment to detect a narrow portion of the well based on the received downhole pressure data.

The present disclosure also introduces a method that includes performing tripping operations with a WDP string within an oil and/or gas well, including moving the WDP string within the well by controlling a drawworks based on downhole data received by wellsite surface equipment via electrical conductors integral to WDP of the WDP string. The received downhole data includes downhole pressure data that is: generated by pressure sensors distributed axially along the WDP string; and indicative of pressure of drilling fluid surrounding the WDP string in the well.

The present disclosure also introduces a method that includes performing drilling operations in an oil and/or gas well with a WDP string comprising a rotary steering tool, including causing operation of a processing device of wellsite surface equipment to transmit control commands to the rotary steering tool to thereby control trajectory of the WDP string. The control commands are: (A) transmitted from the wellsite surface equipment to the rotary steering tool via electrical conductors integral to WDP of the WDP string; and (B) generated by the processing device based on downhole data that is: (i) generated by a downhole navigation sensor; (ii) indicative of the trajectory of the WDP string; and (iii) transmitted from the downhole navigation sensor to the wellsite surface equipment via the electrical conductors.

The present disclosure also introduces an apparatus that includes a control system for controlling well construction equipment operable to perform well construction operations to construct an oil and/or gas well utilizing a WDP string manipulated by the well construction equipment. The control system includes downhole sensors distributed axially along the WDP string. Each downhole sensor is operable to output downhole sensor data indicative of one or more downhole parameters during the well construction operations. The control system also includes an equipment controller communicatively connected with the well construction equipment and including a processing device and a memory storing executable program code that, when executed by the processing device, causes the equipment controller to: (i) make a determination based on at least the downhole sensor data received from the downhole sensors via electrical conductors integral to WDP of the WDP string; and (ii) control the well construction equipment based on the determination. Making the determination may include at least one of: determining, based on the received downhole sensor data and a predetermined well construction plan, an operational sequence to be performed by the well construction equipment; and/or detecting an abnormal downhole event based on at least the received downhole sensor data.

The present disclosure also introduces an apparatus that includes a control system for controlling well construction equipment operable to perform well construction operations to construct an oil and/or gas well utilizing a WDP string manipulated by the well construction equipment, the control system including: (A) downhole sensors distributed axially along the WDP string, each downhole sensor being operable to output downhole sensor data indicative of one or more downhole parameters during the well construction operations; and (B) an equipment controller communicatively connected with the well construction equipment and including a processing device and a memory storing executable program code that, when executed by the processing device, causes the equipment controller to: (i) control the well construction equipment; and (ii) detect abnormal downhole events based on the downhole sensor data received from the downhole sensors via electrical conductors integral to WDP of the WDP string.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
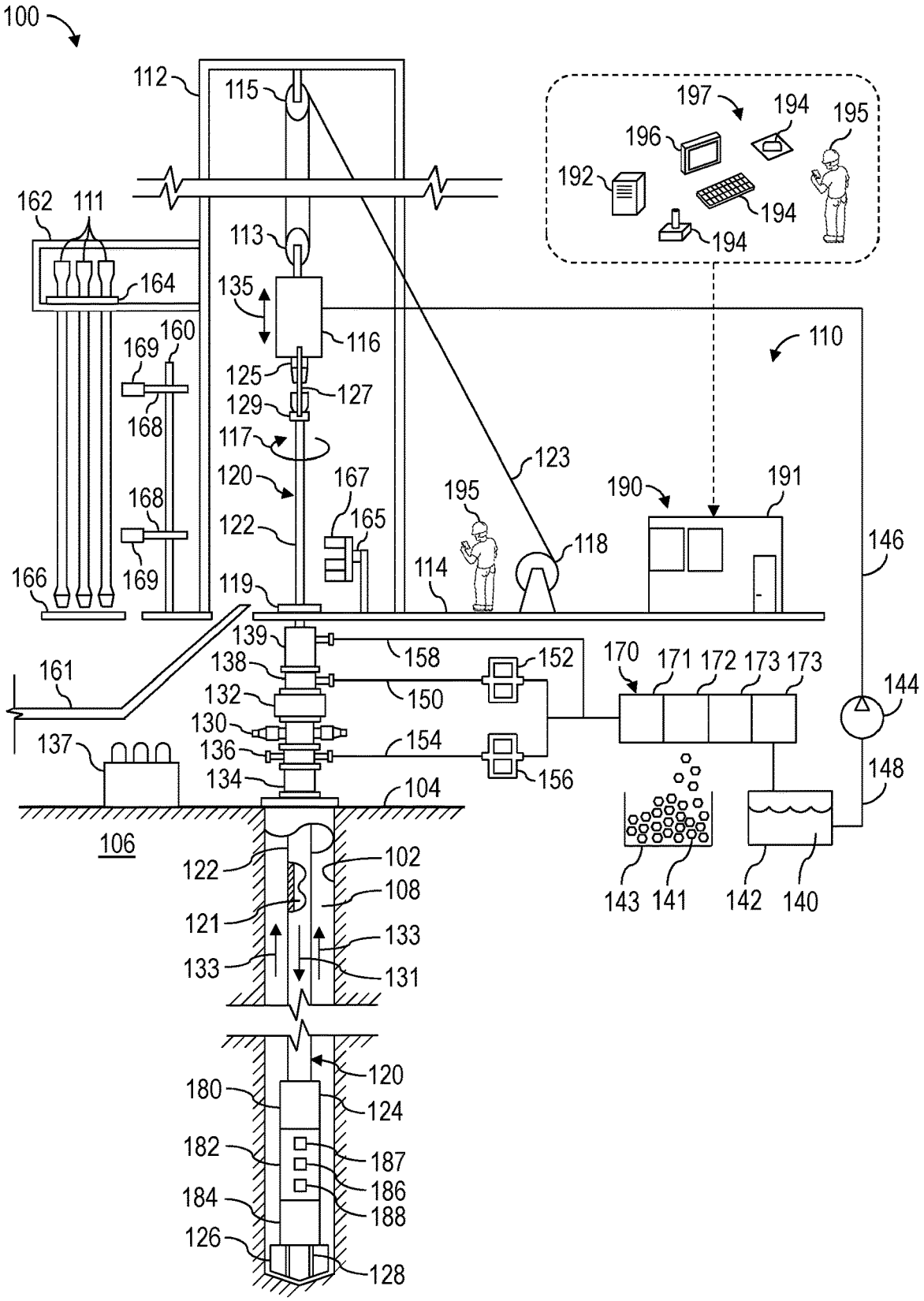
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

Systems and methods (e.g., processes, operations) according to one or more aspects of the present disclosure may be utilized or otherwise implemented in association with an automated well construction system (i.e., well construction rig) at an oil and gas wellsite, such as for constructing a wellbore for extracting hydrocarbons (e.g., oil and/or gas) from a subterranean formation. However, one or more aspects of the present disclosure may be utilized or otherwise implemented in association with other automated systems in the oil and gas industry and other industries. For example, one or more aspects of the present disclosure may be implemented in association with wellsite systems for performing fracturing, cementing, acidizing, chemical injecting, and/or water jet cutting operations, among other examples. One or more aspects of the present disclosure may also be implemented in association with mining sites, building construction sites, and/or other work sites where automated machines or equipment are utilized.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a well construction rig (i.e., a drilling rig). Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 comprises various well construction equipment (i.e., wellsite equipment), including surface equipment 110 located at the wellsite surface 104 and a drill string 120 suspended within the wellbore 102. The surface equipment 110 may include a mast, a derrick, and/or another support structure 112 disposed over a rig floor 114. The drill string 120 may be suspended within the wellbore 102 from the support structure 112. The support structure 112 and the rig floor 114 are collectively supported over the wellbore 102 by legs and/or other support structures.

The drill string 120 may comprise a bottom-hole assembly (BHA) 124 and means 122 for conveying the BHA 124 within the wellbore 102. The conveyance means 122 may comprise a plurality of interconnected tubulars, such as drill pipe, heavy-weight drill pipe (HWDP), WDP, tough logging condition (TLC) pipe, and drill collars, among other examples. The conveyance means 122 may instead comprise coiled tubing for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated from the wellsite surface 104 and/or via a downhole mud motor 184 (i.e., drilling fluid motor) connected with the drill bit 126. The BHA 124 may also include various downhole devices and/or tools 180, 182.

One or more of the downhole tools 180, 182 may be or comprise an MWD or LWD tool comprising one or more sensors 186 operable for the acquisition of measurement and/or logging data pertaining to the BHA 124, the wellbore 102, and/or the formation 106. One or more of the downhole tools 180, 182 and/or another portion of the BHA 124 may also comprise a telemetry device 187 operable for communication with the surface equipment 110, such as via mud-pulse telemetry, electro-magnetic telemetry, and/or via an electrical conductor extending through the drill string 120 (e.g., a wired drill string) to the surface equipment 110. One or more of the downhole tools 180, 182 and/or another portion of the BHA 124 may also comprise a downhole controller 188 (e.g., a processing device) operable to receive, process, and/or store information received from the surface equipment 110, the sensors 186, and/or other portions of the BHA 124. The downhole controller 188 may also store executable computer programs (e.g., program code instructions), including for implementing one or more aspects of the operations described herein.

The support structure 112 may support a driver, such as a top drive 116, operable to connect (perhaps indirectly) with an upper end of the drill string 120, and to impart rotary motion 117 and vertical motion 135 to the drill string 120, including the drill bit 126. However, another driver, such as a kelly and rotary table (neither shown), may be utilized instead of or in addition to the top drive 116 to impart the rotary motion 117 to the drill string 120. The top drive 116 and the connected drill string 120 may be suspended from the support structure 112 via a hoisting system or equipment, which may include a traveling block 113, a crown block 115, and a drawworks 118 storing a support cable or line 123. The crown block 115 may be connected to or otherwise supported by the support structure 112, and the traveling block 113 may be coupled with the top drive 116. The drawworks 118 may be mounted on or otherwise supported by the rig floor 114. The crown block 115 and traveling block 113 comprise pulleys or sheaves around which the support line 123 is reeved to operatively connect the crown block 115, the traveling block 113, and the drawworks 118 (and perhaps an anchor). The drawworks 118 may thus selectively impart tension to the support line 123 to lift and lower the top drive 116, resulting in the vertical motion 135. The drawworks 118 may comprise a drum, a base, and a prime mover (e.g., an engine or motor) operable to drive the drum to rotate and reel in the support line 123, causing the traveling block 113 and the top drive 116 to move upward. The drawworks 118 may be operable to reel out the support line 123 via a controlled rotation of the drum, causing the traveling block 113 and the top drive 116 to move downward.

The top drive 116 may comprise a grabber, a swivel, elevator links 127 terminating with an elevator 129, and a drive shaft 125 operatively connected with a prime mover, such as via a gear box or transmission. The drive shaft 125 may be selectively coupled with the upper end of the drill string 120 and the prime mover may be selectively operated to rotate the drive shaft 125 and the drill string 120 coupled with the drive shaft 125. Hence, during drilling operations, the top drive 116, in conjunction with operation of the drawworks 118, may advance the drill string 120 into the formation 106 to form the wellbore 102. The elevator links 127 and the elevator 129 of the top drive 116 may handle tubulars (e.g., drill pipes, drill collars, casing joints, etc.) that are not mechanically coupled to the drive shaft 125. For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116. The grabber may include a clamp that clamps onto a tubular when making up and/or breaking out a connection of a tubular with the drive shaft 125. The top drive 116 may have a guide system, such as rollers that track up and down a guide rail on the support structure 112. The guide system may aid in keeping the top drive 116 aligned with the wellbore 102, and in preventing the top drive 116 from rotating during drilling by transferring reactive torque to the support structure 112.

The drill string 120 may be conveyed within the wellbore 102 through various fluid control devices disposed at the wellsite surface 104 on top of the wellbore 102 and perhaps below the rig floor 114. The fluid control devices may be operable to control fluid within the wellbore 102. The fluid control devices may include a blowout preventer (BOP) stack 130 for maintaining well pressure control comprising a series of pressure barriers (e.g., rams) between the wellbore 102 and an annular preventer 132. The fluid control devices may also include a rotating control device (RCD) 138 mounted above the annular preventer 132. The fluid control devices 130, 132, 138 may be mounted on top of a wellhead 134. A power unit 137 (i.e., a BOP control or closing unit) may be operatively connected with one or more of the fluid control devices 130, 132, 138 and operable to actuate, drive, operate, or otherwise control one or more of the fluid control devices 130, 132, 138. The power unit 137 may be or comprise a hydraulic fluid power unit fluidly connected with the fluid control devices 130, 132, 138 and selectively operable to hydraulically drive various portions (e.g., rams, valves, seals) of the fluid control devices 130, 132, 138.

The well construction system 100 may further include a drilling fluid circulation system or equipment operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding the drilling fluid 140 (i.e., drilling mud), and one or more mud pumps 144 (i.e., drilling fluid pumps) operable to move the drilling fluid 140 from the container 142 into the fluid passage 121 of the drill string 120 via a fluid conduit 146 extending from the pumps 144 to the top drive 116 and an internal passage extending through the top drive 116. The fluid conduit 146 may comprise one or more of a pump discharge line, a stand pipe, a rotary hose, and a gooseneck connected with a fluid inlet of the top drive 116. The pumps 144 and the container 142 may be fluidly connected by a fluid conduit 148, such as a suction line.

During drilling operations, the drilling fluid may continue to flow downhole through the internal passage 121 of the drill string 120, as indicated by directional arrow 131. The drilling fluid may exit the BHA 124 via ports 128 in the drill bit 126 and then circulate uphole through an annular space 108 ("annulus") of the wellbore 102 defined between an exterior of the drill string 120 and the wall of the wellbore 102, such flow being indicated by directional arrows 133. In this manner, the drilling fluid lubricates the drill bit 126 and carries formation cuttings uphole to the wellsite surface 104. The returning drilling fluid may exit the annulus 108 via different fluid control devices during different phases or scenarios of well drilling operations. For example, the drilling fluid may exit the annulus 108 via a bell nipple 139, the RCD 138, or a ported adapter 136 (e.g., a spool, cross adapter, a wing valve, etc.) located below one or more rams of the BOP stack 130.

During normal drilling operations, the drilling fluid may exit the annulus 108 via the bell nipple 139 and then be directed toward drilling fluid reconditioning equipment 170 via a fluid conduit 158 (e.g., gravity return line) to be cleaned and/or reconditioned, as described below, before being returned to the container 142 for recirculation. During managed pressure drilling operations, the drilling fluid may exit the annulus 108 via the RCD 138 and then be directed into a choke manifold 152 (e.g., a managed pressure drilling choke manifold) via a fluid conduit 150 (e.g., a drilling pressure control line). The choke manifold 152 may include at least one choke and a plurality of fluid valves collectively operable to control the flow through and out of the choke manifold 152. Backpressure may be applied to the annulus 108 by variably restricting flow of the drilling fluid or other fluids flowing through the choke manifold 152. The greater the restriction to flow through the choke manifold 152, the greater the backpressure applied to the annulus 108. The drilling fluid exiting the choke manifold 152 may then pass through the drilling fluid reconditioning equipment 170 before being returned to the container 142 for recirculation. During well pressure control operations, such as when one or more rams of the BOP stack 130 is closed, the drilling fluid may exit the annulus 108 via the ported adapter 136 and be directed into a choke manifold 156 (e.g., a rig choke manifold, well control choke manifold) via a fluid conduit 154 (e.g., rig choke line). The choke manifold 156 may include at least one choke and a plurality of fluid valves collectively operable to control the flow of the drilling fluid through the choke manifold 156. Backpressure may be applied to the annulus 108 by variably restricting flow of the drilling fluid (and other fluids) flowing through the choke manifold 156. The drilling fluid exiting the choke manifold 156 may then pass through the drilling fluid reconditioning equipment 170 before being returned to the container 142 for recirculation.

Before being returned to the container 142, the drilling fluid returning to the wellsite surface 104 may be cleaned and/or reconditioned via the drilling fluid reconditioning equipment 170, which may include one or more of liquid gas (i.e., mud gas) separators 171 (e.g., a poor boy separator), shale shakers 172, and other drilling fluid cleaning and reconditioning equipment 173. The drilling fluid reconditioning equipment 173 may include chemical containers and mixing equipment collectively operable to mix or otherwise add selected chemicals to the drilling fluid returning from the wellbore 102 to modify chemical and/or physical properties or characteristics of the drilling fluid being pumped back into the wellbore 102. The cleaned and reconditioned drilling fluid may be transferred to the fluid container 142, the solid particles 141 removed from the drilling fluid may be transferred to a solids container 143 (e.g., a reserve pit), and/or the removed gas may be transferred to a flare stack (not shown) to be burned or to a container for storage and removal from the wellsite.

The surface equipment 110 may include a tubular handling system or equipment operable to move, store, connect, and disconnect tubulars (e.g., drill pipes) to assemble and disassemble the conveyance means 122 of the drill string 120 during drilling operations. For example, a catwalk 161 may be utilized to convey tubulars from a ground level, such as along the wellsite surface 104, to the rig floor 114. The elevator 129 of the top drive 116 may then grasp the protruding box end of a new tubular, and the drawworks 118 may be operated to lift the top drive 116, the elevator 129, and the new tubular above the wellbore 102 for connection with the previously deployed tubulars. The tubular handling equipment may further include a tubular handling manipulator (THM) (not shown) disposed in association with a vertical pipe rack (not shown) for storing tubulars (e.g., drill pipes, drill collars, drill pipe stands, casing joints, etc.).

An iron roughneck 165 may be positioned on the rig floor 114. The iron roughneck 165 may comprise a torqueing portion 167, such as may include a spinner and a torque wrench comprising a lower tong and an upper tong. The torqueing portion 167 of the iron roughneck 165 may be moveable toward and at least partially around the drill string 120, such as may permit the iron roughneck 165 to make up and break out connections of the drill string 120. The torqueing portion 167 may also be moveable away from the drill string 120, such as may permit the iron roughneck 165 to move clear of the drill string 120 during drilling operations. The spinner of the iron roughneck 165 may be utilized to apply low torque to make up and break out threaded connections between tubulars of the drill string 120, and the torque wrench may be utilized to apply a higher torque to tighten and loosen the threaded connections.

A set of slips 119 may be located on the rig floor 114, such as may accommodate therethrough the drill string 120 during tubular make up and break out operations and during the drilling operations. The slips 119 may be in an open position during drilling operations to permit advancement of the drill string 120, and in a closed position to clamp the upper end (e.g., the uppermost tubular) of the drill string 120 to thereby suspend and prevent advancement of the drill string 120 within the wellbore 102, such as during the make up and break out operations.

During drilling operations, the various well construction equipment of the well construction system 100 may progress through a plurality of coordinated operations (i.e., operational sequences) to drill or otherwise construct the wellbore 102. The operational sequences may change based on a well construction plan, status of the well, status of the subterranean formation, stage of drilling operations (e.g., tripping, drilling, tubular handling, etc.), and type downhole tubulars (e.g., drill pipe) utilized, among other examples.

During drilling operations, the hoisting system lowers the drill string 120 while the top drive 116 rotates the drill string 120 to advance the drill string 120 downward within the wellbore 102 and into the formation 106. During the advancement of the drill string 120, the slips 119 are in an open position, and the iron roughneck 165 is moved away or is otherwise clear of the drill string 120. When the upper end of the drill string 120 (i.e., upper end of the uppermost tubular of the drill string 120) connected to the drive shaft 125 is near the slips 119 and/or the rig floor 114, the top drive 116 ceases rotating and the slips 119 close to clamp the upper end of the drill string 120. The grabber of the top drive 116 then clamps the uppermost tubular connected to the drive shaft 125, and the drive shaft 125 rotates in a direction reverse from the drilling rotation to break out the connection between the drive shaft 125 and the uppermost tubular. The grabber of the top drive 116 may then release the uppermost tubular.

The hoisting system then raises the top drive 116, the elevator 129, and the new tubular until the tubular is aligned with the upper portion of the drill string 120 clamped by the slips 119. The iron roughneck 165 is moved toward the drill string 120, and the lower tong of the torqueing portion 167 clamps onto the upper end of the drill string 120. The spinning system threadedly connects the lower end (i.e., pin end) of the new tubular with the upper end (i.e., box end) of the drill string 120. The upper tong then clamps onto the new tubular and rotates with high torque to complete making up the connection with the drill string 120. In this manner, the new tubular becomes part of the drill string 120. The iron roughneck 165 then releases and moves clear of the drill string 120.

The grabber of the top drive 116 may then clamp onto the drill string 120. The drive shaft 125 is brought into contact with the upper end of the drill string 120 (e.g., the box end of the uppermost tubular) and rotated to make up a connection between the drill string 120 and the drive shaft 125. The grabber then releases the drill string 120, and the slips 119 are moved to the open position. The drilling operations may then resume.

The tubular handling equipment may further include a tubular handling manipulator (THM) 160 disposed in association with a vertical pipe rack 162 for storing tubulars 111 (e.g., drill pipes, drill collars, drill pipe stands, casing joints, etc.). The vertical pipe rack 162 may comprise or support a fingerboard 164 defining a plurality of slots configured to support or otherwise hold the tubulars 111 within or above a setback 166 (e.g., a platform or another area) located adjacent to, along, or below the rig floor 114. The fingerboard 164 may comprise a plurality of fingers, each associated with a corresponding slot and operable to close around and/or otherwise interpose individual tubulars 111 to maintain the tubulars 111 within corresponding slots of the fingerboard 164. The vertical pipe rack 162 may be connected with and supported by the support structure 112 or another portion of the wellsite system 100. The fingerboard 164/setback 166 provide storage (e.g., temporary storage) of tubulars 111 during various operations, such as during and between tripping out and tripping of the drill string 120. The THM 160 may be operable to transfer the tubulars 111 between the fingerboard 164/setback 166 and the drill string 120 (i.e., space above the suspended drill string 120). For example, the THM 160 may include arms 168 terminating with clamps 169, such as may be operable to grasp and/or clamp onto one of the tubulars 111. The arms 168 of the THM 160 may extend and retract, and/or at least a portion of the THM 160 may be rotatable and/or movable toward and away from the drill string 120, such as may permit the THM 160 to transfer the tubular 111 between the fingerboard 164/setback 166 and the drill string 120.

To trip out the drill string 120, the top drive 116 is raised, the slips 119 are closed around the drill string 120, and the elevator 129 is closed around the drill string 120. The grabber of the top drive 116 clamps the upper end of a tubular of the drill string 120 coupled to the drive shaft 125. The drive shaft 125 then rotates in a direction reverse from the drilling rotation to break out the connection between the drive shaft 125 and the drill string 120. The grabber of the top drive 116 then releases the tubular of the drill string 120, and the drill string 120 is suspended by (at least in part) the elevator 129. The iron roughneck 165 is moved toward the drill string 120. The lower tong clamps onto a lower tubular below a connection of the drill string 120, and the upper tong clamps onto an upper tubular above that connection. The upper tong then rotates the upper tubular to provide a high torque to break out the connection between the upper and lower tubulars. The spinning system then rotates the upper tubular to separate the upper and lower tubulars, such that the upper tubular is suspended above the rig floor 114 by the elevator 129. The iron roughneck 165 then releases the drill string 120 and moves clear of the drill string 120.

The THM 160 may then move toward the drill string 120 to grasp the tubular suspended from the elevator 129. The elevator 129 then opens to release the tubular. The THM 160 then moves away from the drill string 120 while grasping the tubular with the clamps 169, places the tubular in the fingerboard 164/setback 166, and releases the tubular for storage. This process is repeated until the intended length of drill string 120 is removed from the wellbore 102.

The surface equipment 110 of the well construction system 100 may also comprise a control center 190 from which various portions of the well construction system 100, such as the top drive 116, the hoisting system, the tubular handling system, the drilling fluid circulation system, the well control system, the BHA 124, among other examples, may be monitored and controlled. The control center 190 may be located on the rig floor 114 or another location of the well construction system 100. The control center 190 may comprise a facility 191 (e.g., a room, a cabin, a trailer, etc.) containing a control workstation 197, which may be operated by rig personnel 195 (e.g., a driller or another human rig operator) to monitor and control various well construction equipment or portions of the well construction system 100. The control workstation 197 may comprise or be communicatively connected with a central controller 192 (e.g., a processing device, a computer, etc.), such as may be operable to receive, process, and output information to monitor operations of and provide control to one or more portions of the well construction system 100. For example, the central controller 192 may be communicatively connected with the various surface and downhole equipment described herein, and may be operable to receive signals from and transmit signals to such equipment to perform various operations described herein. The central controller 192 may store executable computer program code, instructions, and/or operational parameters or set-points, including for implementing one or more aspects of methods and operations described herein. The central controller 192 may be located within and/or outside of the facility 191.

The control workstation 197 may be operable for entering or otherwise communicating control data (e.g., commands, signals, information, etc.) to the central controller 192 and other equipment controller by the rig personnel 195, and for displaying or otherwise communicating information from the central controller 192 to the rig personnel 195. The control workstation 197 may comprise a plurality of human-machine interface (HMI) devices, including one or more input devices 194 (e.g., a keyboard, a mouse, a joystick, a touchscreen, etc.) and one or more output devices 196 (e.g., a video monitor, a touchscreen, a printer, audio speakers, etc.). Communication between the central controller 192, the input and output devices 194, 196, and the various well construction equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100, and are within the scope of the present disclosure.

Figure 2:
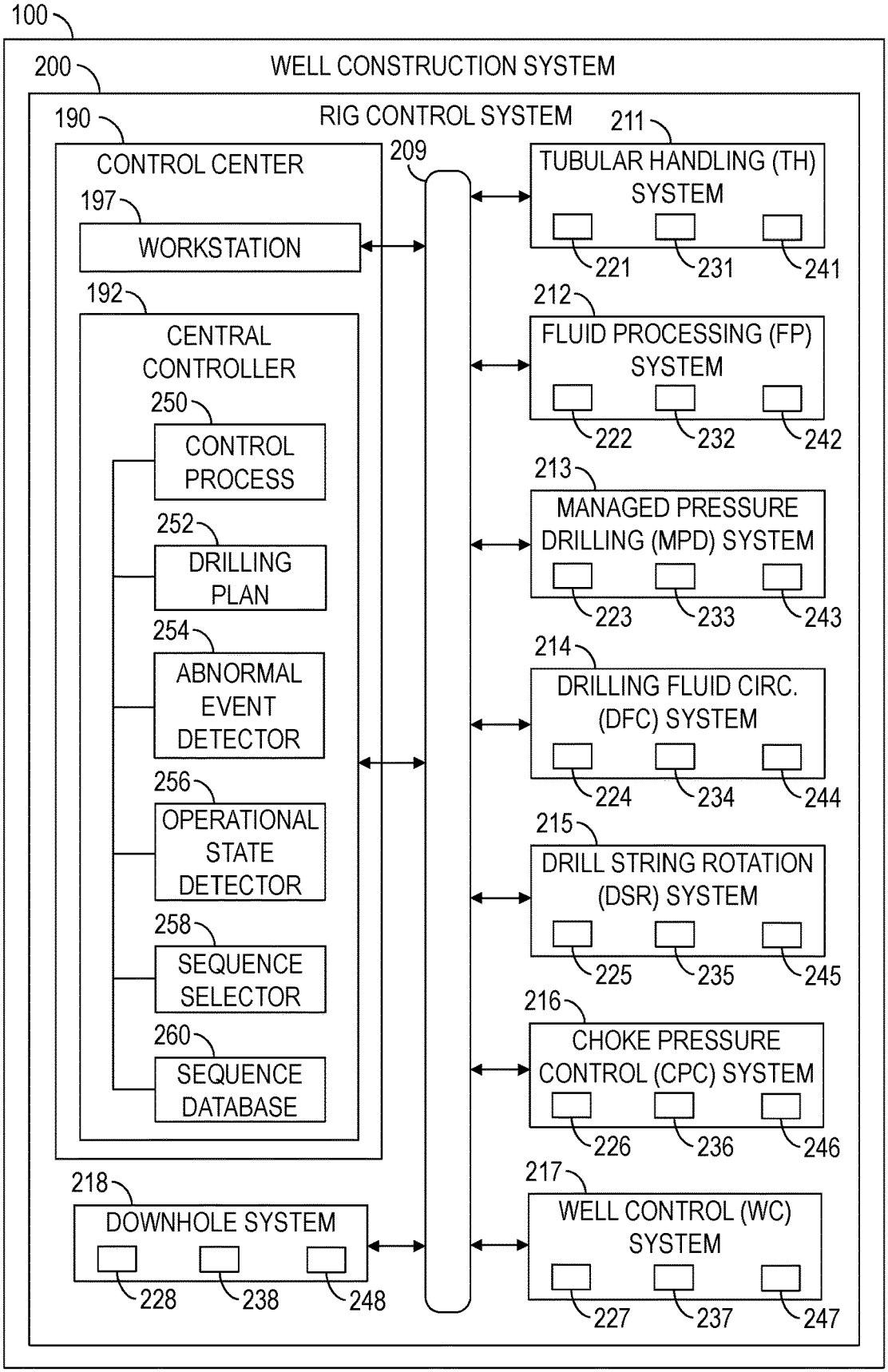
FIG. 2 is a schematic view of at least a portion of an example implementation of apparatus according to one or more aspects of the present disclosure.

The present disclosure further provides various implementations of systems and/or methods for controlling one or more portions of the well construction system 100. FIG. 2 is a schematic view of at least a portion of an example implementation of a control system 200 for monitoring and controlling various equipment, portions, and subsystems of the well construction system 100 shown in FIG. 1. The control system 200 may comprise one or more features of the well construction system 100, including where indicated by the same reference numbers. Accordingly, the following description refers to FIGS. 1 and 2, collectively.

The various pieces of well construction equipment described above and shown in FIGS. 1 and 2 may each comprise one or more (e.g., combustion, hydraulic, and/or electrical) actuators, which when operated, may cause the corresponding well construction equipment to perform intended actions (e.g., work, tasks, movements, operations, etc.). Each piece of well construction equipment may further carry or comprise one or more sensors disposed in association with a corresponding actuator or another portion of the piece of equipment. Each sensor may be communicatively connected with a corresponding equipment controller and operable to generate sensor data (e.g., electrical sensor signals or measurements) indicative of an operational (e.g., mechanical, physical) status of the corresponding actuator or component, thereby permitting the operational status of the actuator to be monitored by the equipment controller. The sensor data may be utilized by the equipment controller as feedback data, permitting operational control of the piece of well construction equipment and coordination with other well construction equipment. Such sensor data may be indicative of performance of each individual actuator and, collectively, of the entire piece of well construction equipment.

The control system 200 may be in real-time communication with and utilized to monitor and/or control various portions, components, and equipment of the well construction system 100 described herein. The equipment of the well construction system 100 may be grouped into several subsystems, each operable to perform a corresponding operation and/or a portion of the well construction operations described herein. The subsystems may include a tubular handling (TH) system 211, a fluid processing (FP) system 212, a managed pressure drilling (MPD) system 213, a drilling fluid circulation (DFC) system 214, a drill string rotation system (DSR) system 215, a choke pressure control (CPC) system 216, a well pressure control (WC) system 217, and a downhole system 218. The control workstation 197 may be utilized to monitor, configure, control, and/or otherwise operate one or more of the subsystems 211-218.

The TH system 211 may include the support structure 112, a tubular hoisting system (e.g., the drawworks 118, the elevator links 127, the elevator 129, the slips 119), a tubular handling system or equipment (e.g., the catwalk 161, the THM 160, the setback 166, and the iron roughneck 165), electrical generators, and other equipment. Accordingly, the TH system 211 may perform power generation controls, and tubular handling and hoisting operations. The TH system 211 may also serve as a support platform for tubular rotation equipment and staging ground for rig operations, such as connection make up and break out operations described above. The FP system 212 may include the drilling fluid reconditioning equipment 170, the flare stack, the containers 142, 143, and/or other equipment. Accordingly, the FP system 212 may perform fluid cleaning, reconditioning, and mixing operations. The MPD system 213 may include the RCD 138, the power unit 137, the choke manifold 152, the pumps 144, the downhole pressure sensors 186, and/or other equipment. The DFC system 214 may comprise the pumps 144, the drilling fluid container 142, the bell nipple 139, and/or other equipment collectively operable to pump and circulate the drilling fluid at the wellsite surface and downhole. The DSR system 215 may include the top drive 116 and/or the rotary table and kelly. The CPC system 216 may comprise the choke manifold 156, the ported adapter 136, and/or other equipment, and the WC system 217 may comprise the BOP stack 130, the power unit 137, and a BOP control station (e.g., BOP control station 370 shown in FIG. 5) for controlling the power unit 137. The downhole system 218 may comprise the drill string 120, including the various portions of the BHA 124, such as the downhole tools 180, 182, the mud motor 184, the sensors 186, the telemetry device 187, the downhole controller 188, and the drill bit 126. The downhole system 218 may be used to drill the wellbore 102 and to monitor various downhole parameters while performing the drilling operations. Each of the well construction subsystems 211-218 may further comprise various communication equipment (e.g., modems, network interface cards, etc.) and communication conductors (e.g., cables), communicatively connecting the equipment (e.g., sensors and actuators) of each subsystem 211-218 with the control workstation 197 and/or other equipment. Although the well construction equipment listed above and shown in FIG. 1 is associated with certain subsystems 211-218, such associations are merely examples that are not intended to limit or prevent such well construction equipment from being associated with two or more subsystems 211-218 and/or different subsystems 211-218.

The control system 200 may include various local controllers 221-228, each operable to control various well construction equipment of a corresponding subsystem 211-218 and/or an individual piece of well construction equipment of a corresponding subsystem 211-218. As described above, each well construction subsystem 211-218 includes various well construction equipment comprising corresponding actuators 241-248 for performing operations of the well construction system 100. Each subsystem 211-218 may include various sensors 231-238 operable to generate sensor data (e.g., signals, information, measurements) indicative of operational status of the well construction equipment of each subsystem 211-218. The downhole sensors 238 may be further operable to output sensor data indicative of downhole parameters, such as condition of the formation 106 and the wellbore fluid (e.g., drilling fluid, formation fluid). Each local controller 221-228 may output control data (e.g., commands, signals, information) to one or more actuators 241-248 to perform corresponding actions of a piece of equipment or subsystem 211-218. Each local controller 221-228 may receive sensor data generated by one or more sensors 231-238 indicative of operational status of an actuator or another portion of a piece of equipment or subsystem 211-218. Although the local controllers 221-228, the sensors 231-238, and the actuators 241-248 are each shown as a single block, it is to be understood that each local controller 221-228, sensor 231-238, and actuator 241-248 may be or comprise a plurality of local controllers, sensors, and actuators.

The sensors 231-238 may include sensors utilized for operation of the various subsystems 211-218 of the well construction system 100. For example, the sensors 231-238 may include cameras, position sensors, speed sensors, force sensors, torque sensors, pressure sensors, temperature sensors, flow rate sensors, vibration sensors, current sensors, voltage sensors, resistance sensors, gesture detection sensors or devices, voice actuated or recognition devices or sensors, and/or other examples. The sensor data may include signals, information, and/or measurements indicative of equipment operational status (e.g., on or off, up or down, set or released, etc.), drilling parameters (e.g., depth, hook load, torque, etc.), auxiliary parameters (e.g., vibration data of a pump), flow rate, temperature, operational speed, position, and pressure, among other examples. The acquired sensor data may include or be associated with a timestamp (e.g., date and/or time) indicative of when the sensor data was acquired. The sensor data may also or instead be aligned with a depth or other drilling parameter.

The local controllers 221-228, the sensors 231-238, and the actuators 241-248 may be communicatively connected with a central controller 192. For example, the local controllers 221-228 may be in communication with the sensors 231-238 and actuators 241-248 of the corresponding subsystems 211-218 via local communication networks (e.g., field buses) and the central controller 192 may be in communication with the subsystems 211-218 via a central communication network 209 (e.g., a data bus, a field bus, a wide-area-network (WAN), a local-area-network (LAN), etc.). The sensor data generated by the sensors 231-238 of the subsystems 211-218 may be made available for use by the central controller 192 and/or the local controllers 221-228. Similarly, control data output by the central controller 192 and/or the local controllers 221-228 may be automatically communicated to the various actuators 241-248 of the subsystems 211-218, perhaps pursuant to predetermined programming, such as to facilitate well construction operations and/or other operations described herein. Although the central controller 192 is shown as a single device (i.e., a discrete hardware component), it is to be understood that the central controller 192 may be or comprise a plurality of equipment controllers and/or other electronic devices collectively operable to perform operations (i.e., computational processes or methods) described herein.

The sensors 231-238 and actuators 241-248 may be monitored and/or controlled by corresponding local controllers 221-228 and/or the central controller 192. For example, the central controller 192 may be operable to receive sensor data from the sensors 231-238 of the subsystems 211-218 in real-time, and to output real-time control data directly to the actuators 241-248 of the subsystems 211-218 based on the received sensor data. However, certain operations of the actuators 241-248 of each subsystem 211-218 may be controlled by a corresponding local controller 221-228, which may control the actuators 241-248 based on sensor data received from the sensors 231-238 of the corresponding subsystem 211-218 and/or based on control data received from the central controller 192.

The control system 200 may be a tiered control system, wherein control of the subsystems 211-218 of the well construction system 100 may be provided via a first tier of the local controllers 221-228 and a second tier of the central controller 192. The central controller 192 may facilitate control of one or more of the subsystems 211-218 at the level of each individual subsystem 211-218. For example, in the FP system 212, sensor data may be fed into the local controller 242, which may respond to control the actuators 232. However, for control operations that involve multiple subsystems 211-218, the control may be coordinated through the central controller 192 operable to coordinate control of well construction equipment of two, three, four, or more (e.g., each) of the subsystems 211-218. For example, coordinated control operations may include the control of downhole pressure during tripping. The downhole pressure may be affected by the DFC system 214 (e.g., pump rate), the MPD system 213 (e.g., position of the choke 152), and the TH system 211 (e.g., tripping speed). Thus, when it is intended to maintain certain downhole pressure during tripping, the central controller 192 may output control data to two or more of the participating subsystems 211-218.

As described above, the central controller 192 may control various operations of the subsystems 211-218 via analysis of sensor data from one or more of the subsystems 211-218 to facilitate coordinated control between the subsystems 211-218. The central controller 192 may generate control data to coordinate operations of various well construction equipment of the subsystems 211-218. The control data may include, for example, commands from rig personnel, such as turn on or turn off a pump, switch on or off a fluid valve, and update a physical property set-point, among other examples. The local controllers 221-228 may each include a fast control loop that directly obtains sensor data and executes, for example, a control algorithm to generate the control data. The central controller 192 may include a slow control loop to periodically obtain sensor data and generate the control data.

The control system 200, including the central controller 192 and the local controllers 221-228, facilitates operation of the well construction equipment in an equipment focused manner, such as to maintain the choke pressure to a certain value or to rotate the drill string at a certain rotational speed. The control system 200 may also coordinate operations of certain pieces of equipment to achieve intended operations, wherein each such operation utilizes coordinated control of multiple pieces of equipment by the central controller 192.

The downhole controller 188, the central controller 192, the local controllers 221-228, and/or other controllers or processing devices (individually or collectively referred to hereinafter as an "equipment controller") of the control system 200 may each or collectively be operable to receive and store machine-readable and executable program code instructions (e.g., computer program code, algorithms, programmed processes or operations) on a memory device (e.g., a memory chip) and then execute the program code instructions to run, operate, or perform a control process for monitoring and/or controlling the well construction equipment of the well construction system 100. The central controller 192 may run (i.e., execute) a control process 250 (e.g., a coordinated control process or anther computer process) and each local controller 221-228 may run a corresponding control process (e.g., a local control process or another computer process). Two or more of the local controllers 221-228 may run their local control processes to collectively coordinate operations between well construction equipment of two or more of the subsystems 211-218.

The control process 250 of the central controller 192 may operate as a mechanization manager of the control system 200, coordinating operational sequences of the well construction equipment of the well construction system 100. The well construction system 100 may instead be operated manually by rig personnel (e.g., a driller). During such manual operation, the rig personnel operates as the mechanization manager of the control system 200 by manually coordinating operations of various well construction equipment, such as to achieve an intended operational status (or drilling state) of the well construction operations, including tripping in or drilling at an intended rate of penetration (ROP). The control process of each local controller 221-228 may facilitate a lower (e.g., basic) level of control within the control system 200 to operate a corresponding piece of well construction equipment or a plurality of pieces of well construction equipment of a corresponding subsystem 211-218. Such control process may facilitate, for example, starting, stopping, and setting or maintaining an operating speed of a piece of well construction equipment. During manual operation of the well construction system 100, rig personnel manually controls the individual pieces of well construction equipment to achieve the intended operational status of each piece of well construction equipment.

The control process 250 of the central controller 192 may output control data directly to the actuators 241-248 to control the well construction operations. The control process 250 may also or instead output control data to the control process of one or more local controllers 221-228, wherein each control process of the local controllers 221-228 may then output control data to the actuators 241-248 of the corresponding subsystem 211-218 to control a portion of the well construction operations performed by that subsystem 211-218. Thus, the control processes of equipment controllers (e.g., central controller 192, local controllers 221-228) of the control system 200 individually and collectively perform monitoring and control operations described herein, including monitoring and controlling well construction operations. The program code instructions forming the basis for the control processes described herein may comprise rules (e.g., algorithms) based upon the laws of physics for drilling and other well construction operations.

Each control process being run by an equipment controller of the control system 200 may receive and process (i.e., analyze) sensor data from the sensors 231-238 according to the program code instructions, and generate control data (i.e., control signals or information) to operate or otherwise control the actuators 241-248 of the well construction equipment. Equipment controllers within the scope of the present disclosure can include, for example, programmable logic controllers (PLCs), industrial computers (IPCs), personal computers (PCs), soft PLCs, variable frequency drives (VFDs) and/or other controllers or processing devices operable to store and execute program code instructions, receive sensor data, and output control data to cause operation of the well construction equipment based on the program code instructions, sensor data, and/or control data.

A control workstation 197 may be communicatively connected with the central controller 192 and/or the local controllers 221-228 via the communication network 209 and operable to receive sensor data from the sensors 231-238 and transmit control data to the central controller 192 and/or the local controllers 221-228 to control the actuators 241-248. Accordingly, the control workstation 197 may be utilized by rig personnel (e.g., a driller) to monitor and control the actuators 241-248 and other portions of the subsystems 211-218 via the central controller 192 and/or local controllers 221-228. The central controller 192 may be located within or form a portion of a control center 190.

An equipment controller of the control system 200 for controlling the well construction system 100 may be operable to automate the well construction equipment to perform well construction operations and change such well construction operations while operational parameters of the well construction operations change and/or when an abnormal event (e.g., state, condition) is detected during the well construction operations. An equipment controller may be operable to detect an abnormal event based on the sensor data received from the sensors 231-238 and cause the predetermined operations to be performed or otherwise implemented to stop or mitigate the abnormal event or otherwise in response to the abnormal event, without manual control of the well construction equipment by the rig personnel via the control workstation 197. For example, an equipment controller may be operable to make decisions related to selection of actions or sequences of operations that are to be implemented during the well construction operations and/or the manner (e.g., speed, torque, power, flow rate, pressure, etc.) in which such selected operational sequences are to be implemented to stop or mitigate a detected abnormal event. An equipment controller may be further operable to receive and store information that may be analyzed by the control process to facilitate the equipment controller to detect the abnormal event, and select and implement the operational sequences to stop or mitigate the abnormal event.

The central controller 192 may be implemented as an equipment controller operable to perform or otherwise implement the monitoring and control operations according to one or more aspects of the present disclosure. Namely, the central controller 192 is shown comprising features (e.g., programs, applications, databases, etc.) that permit the central controller 192 to perform or otherwise implement such monitoring and control operations. However, it is to be understood that one or more of the local controllers 221-228 may also or instead be implemented as the equipment controller(s) operable to perform or otherwise implement such monitoring and control operations.

The central controller 192 may comprise a memory device operable to receive and store a well construction plan 252 (e.g., a drilling plan) for drilling and/or otherwise constructing a planned well. The well construction plan 252 may include well specifications, operational parameters, schedules, and other information indicative of the planned well and the well construction equipment of the well construction system 100. For example, the well construction plan 252 may include properties of the subterranean formation through which the planned well is to be drilled, the path (e.g., direction, curvature, orientation) along which the planned well is to be drilled through the formation, the depth (e.g., true vertical depth (TVD), measured depth (MD)) of the planned well, annular fluid pressure at which the planned well is to be drilled, operational specifications (e.g., power output, weight, torque capabilities, speed capabilities, flow rate capabilities, pressure capabilities, dimensions, size, etc.) of the well construction equipment (e.g., top drive, mud pumps, 144, downhole mud motor 184, etc.) that is planned to be used to construct the planned well, and/or specifications (e.g., diameter, length, weight, etc.) of tubulars (e.g., drill pipe) that are planned to be used to construct the planned well. The well construction plan 252 may further include planned operational parameters of the well construction equipment during the well construction operations, such as weight on bit (WOB), top drive speed (RPM), and ROP as a function of wellbore depth.

The well construction plan 252 may further include well construction operations schedule and/or a plurality of planned well construction tasks (i.e., well construction objectives) that are intended to be achieved to complete the well construction plan 252. Each planned task may comprise a plurality of operational sequences and may be performed by the well construction equipment to construct the planned well. A planned task may be or comprise drilling a predetermined portion or depth of the planned well, completing a predetermined portion or stage of drilling operations, drilling through a predetermined section of the subterranean formation, and performing a predetermined plurality of operational sequences, among other examples. Each operational sequence may comprise a plurality or sequence of physical (i.e., mechanical) operations (i.e., actions) performed by various pieces of well construction equipment. Example operational sequences may include operations of one or more pieces of the well construction equipment of the well construction system 100 described above in association with FIG. 1.

The well construction plan 252 may include knowledge (e.g., efficiency of various parameters) learned from offset wells that have been drilled. Optimal parameters associated with the offset wells may then be used as the recommended parameters in a well construction plan 252. The knowledge learned from the offset wells, including operation limits, such as maximum WOB, RPM, ROP, and/or tripping speed versus depth, may be applied and used as an operation limit within the well construction plan 252. The information forming of otherwise from the well construction plan 252 may originate or be delivered in a paper form, whereby rig personnel manually input such information into the central controller 192. However, the information forming the well construction plan 252 may originate or be delivered in digital format, such that it can be directly loaded to or saved by a memory device of the central controller 192.

The well construction plan 252 can be executed or analyzed programmatically by a computer process (e.g., the control process 250) of the central controller 192 without human intervention. The memory device storing the well construction plan 252 may be or form a portion of the central controller 192 or the memory device storing the well construction plan 252 may be communicatively connected with the central controller 192. The computer process ran by the central controller 192 may analyze the well construction plan 252 and generate or output control data to the local controllers 221-228 or directly to the actuators 241-248 to control the well construction equipment to cause, facilitate, or otherwise implement one or more aspects of methods and operations described herein.

The central controller 192 may be operable to receive and store machine-readable and executable program code instructions on a memory device and then execute the program code instructions to run, operate, or perform an abnormal event detector 254 (e.g., an abnormal event detecting computer process), which may be operable to analyze or otherwise process the sensor data received from the sensors 231-238 and detect an abnormal event (e.g., status, condition) experienced by or otherwise associated with one or more pieces of well construction equipment, and/or an abnormal event experienced by or otherwise associated with a wellbore (e.g., the wellbore 102 shown in FIG. 1). The abnormal event detector 254 may be operable to detect the abnormal events based on the sensor data and output abnormal event data indicative of the detected abnormal event. The central controller 192 may then re-plan well construction tasks, operational sequences, and other processes based on the detected abnormal events or otherwise based on the condition of the well and/or the well construction equipment.

For example, an abnormal event may be or comprise an abnormal operational surface event experienced by surface equipment (e.g., the surface equipment 110 shown in FIG. 1) and/or an abnormal operational downhole event experienced by a drill string (e.g., the drill string 120 shown in FIG. 1). An example abnormal operational downhole event may include stick slip, axial vibrations, lateral vibrations, rotational vibrations, and stuck drill pipe. The abnormal event may instead be or comprise an abnormal downhole fluid event experienced by a downhole fluid, such as wellbore fluid (e.g., drilling fluid, formation fluid) within the wellbore, and/or formation fluid within a rock formation (e.g., rock formation 106 shown in FIG. 1) through which the wellbore extends. An example abnormal downhole fluid event may include underpressure of the formation fluid, overpressure of the formation fluid, gains of the wellbore fluid, and losses of the wellbore fluid.

The central controller 192 may be operable to receive and store machine-readable and executable program code instructions on a memory device and then execute the program code instructions to run, operate, or perform an operational state detector 256 (e.g., an operational state detecting computer process), which may be operable to analyze or otherwise process the sensor data received from the sensors 231-238 and/or downhole sensors (e.g., downhole sensors 186 shown in FIG. 1) and detect a state (e.g., a status, a phase) of the well construction operations the well construction system 100 is performing. The operational state detector 256 may then output operational state data indicative of the operational state of the well construction system 100. Operational states of the well construction system 100 may comprise, for example, drilling, tripping, circulating, and reaming.

The central controller 192 may be operable to receive and store machine-readable and executable program code instructions on a memory device and then execute the program code instructions to run, operate, or perform an operational sequence selector 258 (e.g., an operational sequence selecting computer process) operable to select and output an operational sequence (e.g., a plurality or series of physical or mechanical operations, actions, or movements) to be performed by the well construction equipment. The operational sequence selector 258 (or generator) may be operable to receive and analyze or otherwise process various data to select (or generate) an operational sequence. For example, the operational sequence selector 258 may be operable to receive and analyze the well construction plan 252, the sensor data from the sensors 231-238, the operational state data from the operational state detector 256, and/or the abnormal event data from the abnormal event detector 254, and select an (e.g., optimal) operational sequence to be performed by the well construction equipment based on such well construction plan 252, sensor data, operational state data, and/or abnormal event data.

The operational sequence selector 258 may be operable to analyze or otherwise process the well construction plan 252 and discretize (e.g., break up or segment) the well construction plan 252 into a plurality of planned tasks or operational sequences that can be implemented (i.e., caused to be performed) by the central controller 192. For example, the operational sequence selector 258 may be operable to analyze or otherwise process the well construction plan 252 and discretize each planned task (e.g., step) defined in the well construction plan 252 into one or more discrete operational sequences that can be received and implemented by the central controller 192. A planned task may include, for example, drilling from depth A to depth B with the set of operation parameters, performing a survey, or performing a telemetry operation. Thus, the operational sequence selector 258 may be operable to select an operational sequence to be performed by the well construction equipment to perform a planned task defined in the well construction plan 252. The control process 250 may then receive the selected operational sequence to be performed by the well construction equipment and, based on such selected operational sequence, output control data to cause the well construction equipment to perform the selected operational sequence and, thus, the corresponding planned task. The operational sequence selected and output by the operational sequence selector 258 based on the well construction plan 252 may be referred to hereinafter as a planned operational sequence.

The operational sequence selector 258 may also or instead be operable to analyze or otherwise process the detected abnormal event and select an operational sequence to be performed by the well construction equipment based on such abnormal event to stop or otherwise mitigate the detected abnormal event. The control process 250 may then receive the selected operational sequence to be performed by the well construction equipment and, based on such selected operational sequence, output control data to cause the well construction equipment to perform the selected operational sequence, thereby mitigating the abnormal downhole event. The control process 250 may cause the well construction equipment to perform the operational sequence selected based on the detected abnormal event while the planned operational sequence is still being performed. However, the control process 250 may instead output control data to cause the well construction equipment to stop performing the planned operational sequence, before outputting the control data to cause the well construction equipment to perform the operational sequence selected based on the detected abnormal event. The operational sequence selected and output by the operational sequence selector 258 based on the detected abnormal event may be referred to hereinafter as a mitigating operational sequence.

The central controller 192 may further comprise a memory device operable to receive and store a database 260 (e.g., a library) of operational sequences that may be performed by the well construction equipment. Each operational sequence may comprise a plurality or series of physical or mechanical operations (e.g., actions, movements) that may be performed by one or more pieces of the well construction equipment.

Some of the operational sequences (e.g., planned operational sequences) may be performed by corresponding pieces of the well construction equipment to perform a corresponding planned portion of the well construction operations (e.g., to drill a corresponding stage of the planned well). The database 260 may store operational sequences for performing each planned well construction task of the well construction plan 252. The database 260 may store a plurality of alternate operational sequences associated with (i.e., for performing) a planned well construction task or a procedure (e.g., a portion of a well construction task comprising a plurality of mechanical operations) to be performed by the well construction equipment, such as when a status or certain condition of well construction operations changes. Thus, each well construction task or procedure may be associated with a plurality of different and/or alternate planned operational sequences for performing a planned well construction task or procedure. Thus, each planned operational sequence associated with a planned well construction task may comprise a different plurality of actions or movements to be performed by the well construction equipment to perform the planned well construction task or procedure.

Some of the operational sequences (e.g., mitigating operational sequences) may be performed by corresponding pieces of the well construction equipment to stop or otherwise mitigate a detected abnormal event. The database 260 may store a plurality of alternate operational sequences associated with (i.e., for performing) various types and/or levels of abnormal events that can take place during well construction operations. For each abnormal event, one or more operational sequences may be defined in association with corresponding priority and/or decision making steps, and saved in the database 260 and/or as part of the operational sequence selector 258. The operational sequence selector 258 may automatically select one or more of the most responsive or optimal operational sequences based on parameters (e.g., type, severity, duration of time, etc.) of the abnormal event. Some abnormal events may be associated with a plurality of different and/or alternate planned operational sequences for performing a planned well construction task or procedure while stopping or otherwise mitigating the detected abnormal event and/or the effects of the detected abnormal event. Some abnormal events may be associated with a plurality of different and/or alternate planned operational sequences that are performed to stop or otherwise mitigate the detected abnormal event after a previously selected planned operational sequence is stopped. Thus, each mitigating operational sequence associated with a different abnormal event may comprise a different plurality of actions or movements to be performed by the well construction equipment to stop or otherwise mitigate the detected abnormal event. Thus, when an abnormal event is detected, the control process 250 may stop performance of a previously selected planned operational sequence, the operational sequence selector 258 may select a mitigating operational sequence based on the detected abnormal event, and the control process 250 may output control data to cause the well construction equipment to perform the selected mitigating operational sequence thereby mitigating the abnormal downhole event without manual control of the well construction equipment by the rig personnel via the control workstation 197.

The memory device storing the database 260 may be or form a portion of the central controller 192. For example, the database 260 may be stored on a memory device (e.g., a memory chip) of the central controller 192 that is different from the memory device on which the executable program code instructions for the control process 250 and/or the operational sequence selector 258 are stored. The database 260 may also or instead be stored on the same memory device that stores the executable program code instructions for the control process 250 and/or the operational sequence selector 258. The database 260 may also or instead be stored on a memory device external from the central controller 192 communicatively connected with the central controller 192. The database 260 may be or form a portion of the operational sequence selector 258 or the operational sequence selector 258 may have access to the planned and mitigating operational sequences stored in the database 260. Therefore, the operational sequence selector 258 may be operable to select from the database 260 an operational sequence to be performed by the well construction equipment.

The control process 250 is operable to receive a selected operational sequence from the sequence selector 258 and automatically operate the well construction equipment accordingly to implement the selected operational sequence. For example, if the selected operational sequence is to trip in a stand at a predetermined tripping speed, with the pump turned off, the control process 250 can ensure that the pump is turned off and that the drawworks is running at an intended speed. If the selected operational sequence is to trip in a drill string from depth A to depth B, which may mandate the well construction system 100 to run multiple stands automatically, the control process can automatically manage and synchronize multiple pieces of well construction equipment, including, tripping, setting slips, breaking connections, picking up a new stand, making connections, releasing slips, and tripping in, without manual control of the well construction equipment by rig personnel via the control workstation 197.

Figure 3:
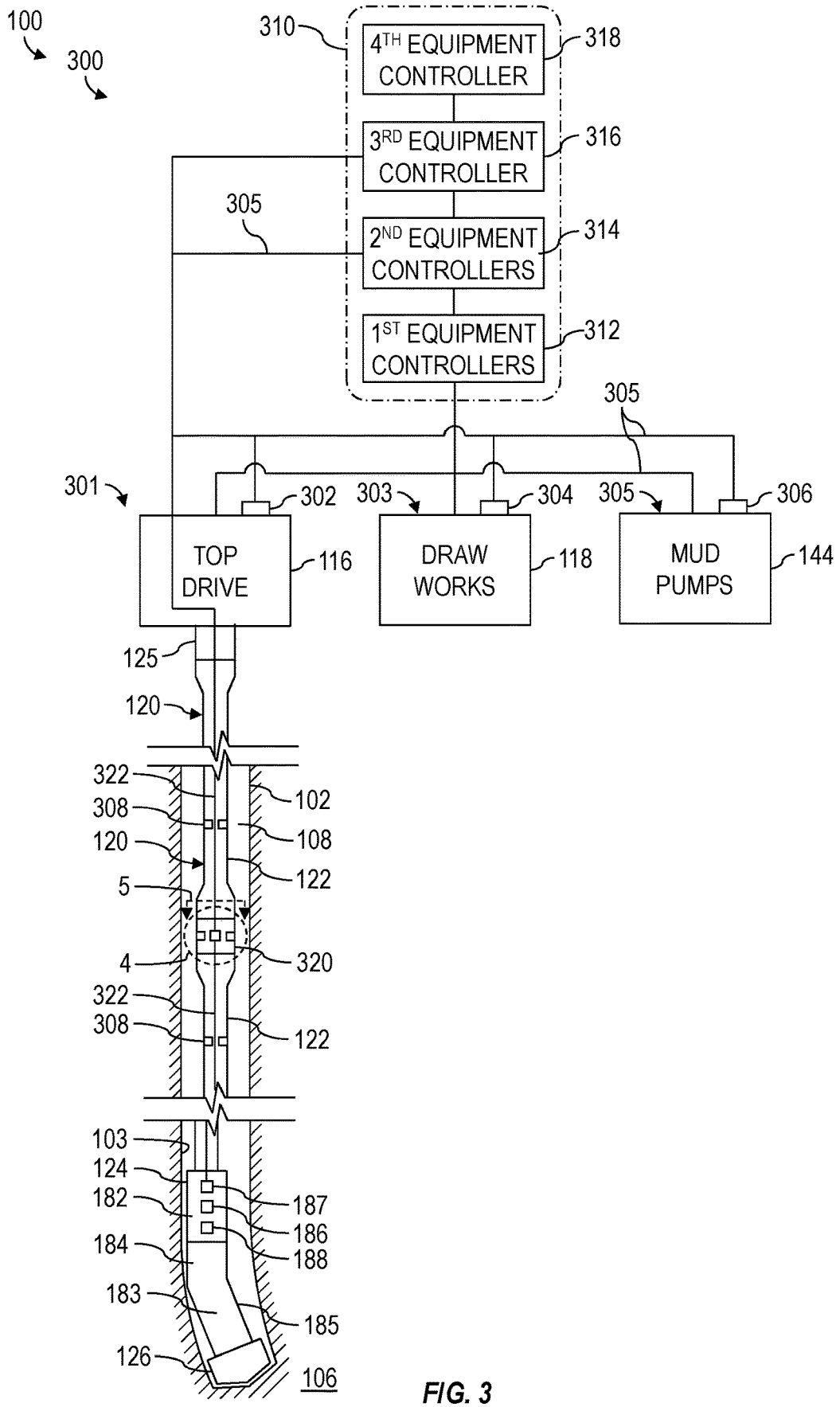
FIG. 3 is a schematic view of at least a portion of an example implementation of apparatus according to one or more aspects of the present disclosure.

FIG. 3 is a schematic view of at least a portion of an example implementation (or application) of the control system 300 for monitoring and controlling operation of various subsystems or equipment of the well construction system 100 shown in FIG. 1 according to one or more aspects of the present disclosure. The control system 300 may be or comprise a portion of the control system 200 shown in FIG. 2, and may form a portion of or operate in conjunction with the well construction system 100. The control system 300 may comprise one or more features of the well construction system 100 and the control system 200, including when identified by the same reference numerals. Accordingly, the following description refers to FIGS. 1-3, collectively.

The control system 300 may be communicatively connected with and utilized to control at least a portion of a drill string rotation system 301 ("rotation system"), a drill string hoisting system 303 ("hoisting system"), and a drilling fluid circulation system 305 ("circulation system"). The control system 300 may comprise one or more equipment controllers 310 (e.g., information processing devices), such as variable frequency drives (VFDs), programmable logic controllers (PLCs), computers (PCs), industrial computers (IPC), or other controllers equipped with control logic, communicatively connected with various sensors and actuators of the rotation system 301, the hoisting system 303, and the circulation system 305. The sensors of the rotation system 301, the hoisting system 303, and the circulation system 305 may instead be considered part of the control system 300. One or more of the equipment controllers 310 may be in real-time communication with such sensors and actuators, and utilized to monitor and/or control various portions, components, and equipment of the rotation system 301, the hoisting system 303, and the circulation system 305. Communication between one or more of the equipment controllers 310 and the sensors and actuators may be via wired and/or wireless communication means 305. A person having ordinary skill in the art will appreciate that such communication means are within the scope of the present disclosure.

The rotation system 301 may comprise a top drive 116 and a mud motor 184. The top drive 116 may comprise an electric motor operatively connected to a drive shaft 125 of the top drive 116 via a transmission or gear box. During drilling operations, the drive shaft 125 may be coupled with the top end of a drill string 120 terminating at the lower end with a BHA 124. The BHA 124 may include a downhole tool 180 and the mud motor 184 configured to rotate a drill bit 126. The mud motor 184 may be connected to the drill bit via a bent sub 183. The mud motor 184 may comprise a motor toolface 185 aligned with the direction of the bent sub 183 and the drill bit 126. The control system 300 may be utilized to control rotation of the drill bit 126 and the mud motor 184, at least partially, by monitoring and controlling operation (i.e., rotational position, rotational speed, torque) of the top drive 116. The drill string rotation system 301 may be or comprise at least a portion of the DSR system 215 shown in FIG. 2.

The hoisting system 303 may comprise a drawworks 118. The drawworks 118 may comprise a drum, a base, and an electric motor operable to drive the drum to rotate and reel in a support line, causing the top drive 116 to move upward. The drawworks 118 may be operable to reel out the support line via a controlled rotation of the drum, causing the top drive 116 to move downward. The control system 300 may be utilized to control vertical movement of the drill string 120, at least partially, by monitoring and controlling operation (i.e., rotational position, rotational speed) of the drawworks 118. The hoisting system 303 may be or comprise at least a portion of the TH system 211 shown in FIG. 2.

The circulation system 305 may comprise mud pumps 144. Each pump 144 may comprise an engine or electric motor operable to drive a fluid portion of each pump 144 to selectively pump drilling fluid from a drilling fluid container into a fluid passage of the drill string 120 via a fluid conduit extending from the pump to the top drive 116 and an internal passage extending through the top drive 116 into the drill string 120. The control system 300 may be utilized to control circulation of the drilling fluid through the drill string 120, at least partially, by monitoring and controlling operation (i.e., operating speed) of the mud pumps 144. The circulation system 305 may be or comprise at least a portion of the DFC system 214 shown in FIG. 2.

The control system 300 may comprise one or more sensors 302, 304, 306 associated with corresponding rotation, hoisting, and circulation systems 301, 303, 305. The sensors 302 associated with the rotation system 301 may be operatively connected with and/or disposed in association with the top drive 116 and operable to output sensor data indicative of torque, position, speed, and/or acceleration of the top drive 116. The sensors 302 may be communicatively connected with one or more of the equipment controllers 310 and operable to output the sensor data to one or more of the equipment controllers 310. For example, the sensors 302 may comprise a rotation sensor operable to output or otherwise facilitate rotational sensor data (e.g., sensor signals or measurements) indicative of rotational (i.e., angular) position of the drive shaft 125 of the top drive 116. The rotation sensor may be disposed or installed in association with, for example, the electric motor to monitor rotational position of the electric motor and, thus, the drive shaft 125. The rotation sensor may instead be disposed or installed in association with, for example, a rotating member of the gear box to monitor rotational position of the rotating member and, thus, the drive shaft 125. The rotation sensor may instead be disposed or installed in direct association with, for example, the drive shaft 125 to monitor rotational position of the drive shaft 125. The rotational position measurements may be further indicative of rotational distance (i.e., number of rotations), rotational speed, and rotational acceleration of the drive shaft 125. The rotation sensor may be or comprise, for example, an encoder, a rotary potentiometer, and a rotary variable-differential transformer (RVDT). The sensors 302 may also or instead comprise a torque sensor (e.g., a torque sub) operable to output torque sensor data (e.g., torque signals or measurements) indicative of torque that was output by the drive shaft 125 of the top drive 116 to the drill string 120. The torque sensor may be mechanically connected or otherwise disposed between the drive shaft 125 and the upper end of the drill string 120, such as may permit the torque sensor to transfer and measure torque. The torque sensor may also facilitate determination of rotational position, rotational distance, rotational speed, and rotational acceleration of the drive shaft 125. One or more of the equipment controllers 310 may also or instead be operable to calculate or determine torque generated or output by the electric motor of the top drive 116 to the drill string 120, such as based on the electrical power (e.g., current, voltage, frequency) delivered to the electric motor of the top drive 116. The sensors 302 may be example implementations of the sensors 235 of the control system 200 shown in FIG. 2.

The sensors 304 associated with the hoisting system 303 may be operatively connected with and/or disposed in association with the drawworks 118 and operable to output sensor data indicative of vertical position (i.e., height), speed, and/or acceleration of the moving block 113 and the top drive 116. The sensors 304 may be communicatively connected with one or more of the equipment controllers 310 and operable to output the sensor data to one or more of the equipment controllers 310. For example, the sensors 304 may comprise a rotation sensor operable to output or otherwise facilitate rotational sensor data (e.g., sensor signals or measurements) indicative of rotation of the drawworks 118. The rotational sensor data may in turn be indicative of vertical position (i.e., height) of the moving block 113 and the top drive 116. The rotation sensor may be disposed or installed in association with, for example, the electric motor of the drawworks 118 to monitor rotational position of the electric motor and, thus, the vertical position (i.e., height) of the moving block 113 and the top drive 116. The rotation sensor may instead be disposed or installed in association with, for example, a drum of the drawworks 118 to monitor rotational position of the drum and, thus, the vertical position (i.e., height) of the moving block 113, the top drive 116, and the drill string 120. The rotational sensor data may be further indicative of rotational speed and rotational acceleration of the drawworks 118 and, thus, indicative of vertical speed and vertical acceleration of the moving block 113, the top drive 116, and the drill string 120. The rotation sensor may be or comprise, for example, an encoder, a rotary potentiometer, and a rotary variable-differential transformer (RVDT). The sensors 304 may be example implementations of the sensors 231 of the control system 200 shown in FIG. 2.

The sensors 306 associated with the circulation system 305 may be operatively connected with and/or disposed in association with the mud pumps 144 and operable to output sensor data indicative of flow rate of the drilling fluid discharged downhole via the drill string 120. The sensors 306 may be communicatively connected with one or more of the equipment controllers 310 and operable to output the sensor data to one or more of the equipment controllers 310. For example, the sensors 306 may be or comprise rotation sensors operable to output or otherwise facilitate rotational speed sensor data (e.g., sensor signals or measurements) indicative of operating speed of the mud pumps 144. The rotational speed sensor data may in turn be indicative of flow rate of the drilling fluid discharged downhole via the drill string 120. Each rotation sensor may be disposed or installed in association with, for example, a rotary actuator (e.g., engine, electric motor), a crankshaft, or another rotating or otherwise moving portion of the corresponding pump to monitor operational (e.g., rotational) speed of the pump and, thus, flow rate of the pump. The rotation sensor may be or comprise, for example, an encoder, a rotary potentiometer, and a rotary variable-differential transformer (RVDT). The sensors 306 may also or instead comprise flow rate sensors disposed at fluid outlets of the pumps and operable to output sensor data indicative of flow rate of the drilling fluid discharged downhole via the drill string 120. The sensors 306 may be example implementations of the sensors 234 of the control system 200 shown in FIG. 2.

The control system 300 may further comprise a plurality of sensors 308 disposed along or otherwise carried by the drill string 120. The sensors 308 may be distributed at various vertical positions (i.e., heights) along the drill string 120 between the wellsite surface and the drill bit 126, and may thus be referred to as distributed downhole sensors 308. One or more of the sensors 308 may be installed or imbedded within each segment (i.e., joint) of drill pipe 122, or one or more of the sensors 308 may be installed or imbedded within selected segments of drill pipe 122, such as every two, three, four, or more segments of drill pipe 122 making up the drill string 120. One or more of the sensors 308 may be installed or imbedded within a sensor sub 320, which may be connected between each segment of drill pipe 122, or at predetermined intervals of drill pipe 122, such as every two, three, four, or more segments of drill pipe 122. The sensors 308 may also or instead be imbedded, installed, or otherwise disposed at predetermined distance (i.e., depth) intervals along the drill string 120.

Figure 4:
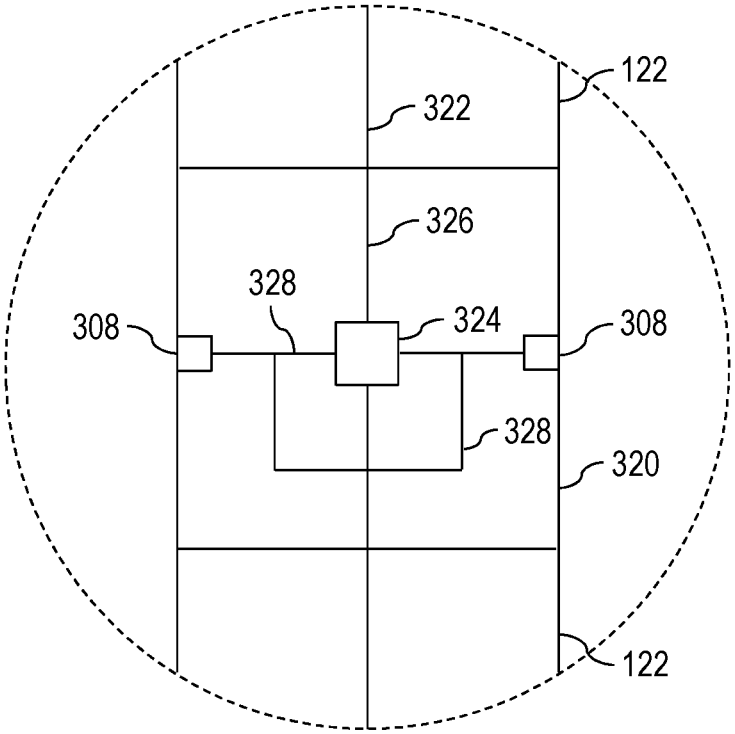
FIG. 4 is an enlarged view of a portion of the apparatus shown in FIG. 3 according to one or more aspects of the present disclosure.
Figure 5:
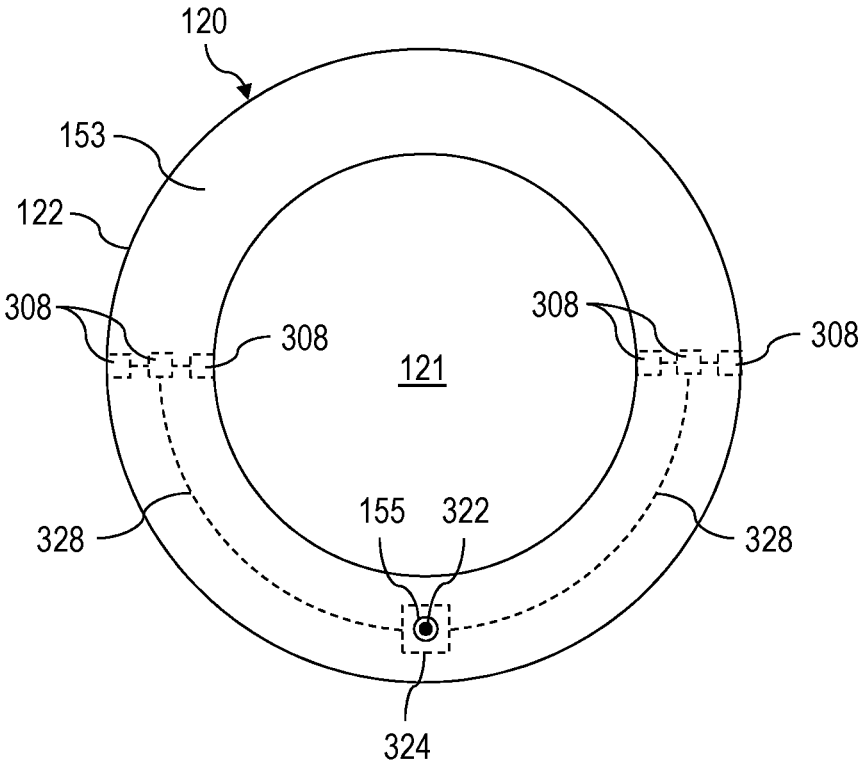
FIG. 5 is a sectional view of a portion of the apparatus shown in FIG. 3 according to one or more aspects of the present disclosure.

The following description further refers to FIGS. 4 and 5, each showing a portion of the drill string 120 shown in FIG. 3 according to one or more aspects of the present disclosure. Namely, FIG. 4 shows an enlarged view of a portion of the drill string 120, including the sensor sub 320 and portions of adjacent drill pipes 122, and FIG. 5 shows a sectional view of a portion of the drill string 120, namely, the drill pipe 122 connected above the sensor sub 320. The sensors 308 may be installed or integrated within the drill pipe walls 153 and/or sensor sub walls. Some of the sensors 308 may be installed along or be communicatively connected with (e.g., via a fluid passage) an outer surface of the drill string 120, such as to permit pressure measurements of fluid located outside of the drill string 120. Some of the sensors 308 may also or instead be installed along or be communicatively connected with (e.g., via a fluid passage) an inner surface of the drill string 120, such as to permit pressure measurements of fluid located within the fluid passage 121 of the drill string 120. Some of the sensors 308 may also or instead be installed at intermediate locations between inner and outer surfaces of the drill pipes 122 and the sensor subs 320. The sensors 308 may be installed on one or multiple (e.g., opposing) sides of the drill pipes 122 and the sensor subs 320. FIG. 5 shows the sensors 308 in phantom lines because such features are located within a sensor sub 320 that is located below the shown cross-sectional plane of the drill pipe 122.

The sensors 308 may be communicatively connected with one or more of the equipment controllers 310 via an electrical conductor 322 extending along the drill string 120. The electrical conductor 322 (e.g., a wire, a cable) may comprise a plurality of electrical conductor segments, each extending along a corresponding segment of drill pipe 122 and/or sensor sub 320 forming the drill string 120. The electrical conductor 322 may be imbedded or otherwise integrated within the wall 153 of the drill pipes 122 and/or sensor subs 320 forming the drill string 120. For example, the electrical conductor 322 may pass through a passage 155 (e.g., a bore) extending axially through the wall 153 of the drill pipes 122 and the sensor sub 320. Thus, the drill pipes 122 may be or comprise WDP and the drill string may be or comprise a WDP string 120. The electrical conductor 322 may be communicatively connected with one or more portions of the BHA 124. For example, the electrical conductor 322 may be communicatively connected with one or more of the downhole sensors 186, the telemetry device 187, and the downhole controller 188. The electrical conductor 322 may be operable to transmit sensor data from the downhole sensors 186 and the distributed sensors 308 to one or more of the equipment controllers 310. The electrical conductor 322 may be further operable to transmit sensor data from the distributed sensors 308 to the downhole controller 188. The electrical conductor 322 may be further operable to transmit sensor data at high frequencies and at high data transfer rates. The sensors 186, 308 may be example implementations of the sensors 238 of the control system 200 shown in FIG. 2.

The tool string 120 may comprise a plurality of repeater subs coupled between (i.e., in series with) predetermined number of segments of drill pipe 122 and/or at predetermined distance (i.e., depth) intervals along the drill string 120. Each repeater sub may comprise a signal repeater 324 operable to repeat and amplify (i.e., increase) strength of electrical signals being communicated along the electrical conductor 322. The repeater subs may be coupled along the drill string 120 in addition to the sensor subs 320. However, each sensor sub 320 according to one or more aspects of the present disclosure may comprise both an electrical repeater 324 and one or more of the sensors 308. Thus, each sensor sub 320 according to one or more aspects of the present disclosure may operate both as a repeater sub and as a sensor sub.

Each sensor sub 320 may be configured to electrically connect the signal repeater 324 and the sensor(s) 308 of the sensor sub 320 along the electrical conductor 322 when the sensor sub 320 is coupled within the drill string 120. The sensor sub 320 may further comprise an electrical conductor 326 configured to electrically connect with or along the electrical conductor 322 of the drill pipe 122 when the sensor sub 320 is coupled within or along the drill string 120. The signal repeater 324 may be electrically connected with the electrical conductor 326 to electrically connect with or along the electrical conductor 322. The sensor(s) 308 may be electrically connected with at least one of the signal repeater 324 and the electrical conductor 326 via electrical conductor(s) 328 to electrically and communicatively connect the sensor(s) 308 with the electrical conductor 322 of the drill string 120. FIG. 5 further shows the signal repeater 324 and the electrical conductors 328 in phantom lines because such features are located in a sensor sub 320 that is located below the shown cross-sectional plane of the drill pipe 122.

Each distributed sensor 308 may be operable to output downhole sensor data (e.g., electrical sensor signals or measurements) indicative of a downhole parameter, such as a condition of a downhole object (e.g., a downhole tool, downhole equipment, a downhole rock formation, a downhole fluid, etc.) and/or a status (e.g., condition, phase, magnitude, etc.) of a downhole operational parameter of a downhole object (e.g., a downhole tool, downhole equipment). For example, the distributed sensors 308 may be or comprise rotation sensors (e.g., gyroscopes, magnetometers, accelerometers) operable to output or otherwise facilitate rotational sensor data (e.g., signals or measurements) indicative of rotational position, rotational distance, rotational speed, and/or rotational acceleration of a corresponding portion of the drill string 120. The distributed sensors 308 may also or instead be or comprise torque sensors (e.g., load cells, strain gauges) operable to output or otherwise facilitate torque sensor data (e.g., signals or measurements) indicative of torque being transferred and/or experienced by a corresponding portion of the drill string 120. The distributed sensors 308 may also or instead be or comprise axial load (i.e., weight) sensors (e.g., load cells, strain gauges) operable to output or otherwise facilitate axial load sensor data (e.g., signals or measurements) indicative of axial force or weight being applied to, supported by, and/or experienced by a corresponding portion of the drill string 120. The distributed sensors 308 may also or instead be or comprise accelerometers (e.g., piezoelectric accelerometers, strain gauge accelerometers) operable to output or otherwise facilitate acceleration sensor data (e.g., signals or measurements) indicative of axial, lateral, rotational, and/or other acceleration (e.g., shock, oscillations, vibrations) experienced by a corresponding portion of the drill string 120. The distributed sensors 308 may also or instead be or comprise pressure sensors (e.g., pressure gauges) operable to output or otherwise facilitate pressure sensor data (e.g., signals or measurements) indicative of ambient wellbore pressure of wellbore fluid at or around a corresponding portion of the drill string 120. The distributed sensors 308 may also or instead be or comprise pressure sensors (e.g., pressure gauges) operable to output or otherwise facilitate pressure sensor data (e.g., signals or measurements) indicative of pressure of drilling fluid being pumped from the surface to the drill bit 126 via the internal fluid pathway 121 at a corresponding location of the drill string 120.

The equipment controllers 310 may be divided into or otherwise comprise hierarchical control levels or layers. A first control level may comprise a plurality of first equipment controllers 312 (i.e., actuator controllers), such as VFDs, each operable to directly power and control (i.e., drive) an electric motor or another electric actuator of a corresponding piece of equipment. Each first equipment controller 312 may be electrically connected with a corresponding electric motor or actuator, and may be supported by or disposed in close association with the corresponding electric motor or actuator. Each first equipment controller 312 may be operable to control operation (e.g., rotational speed and torque) of a corresponding electric motor or actuator and, thus, control operation of a corresponding one of the top drive 116, the draw works 118, and the mud pumps 144. Each first equipment controller 312 may control electrical power (e.g., current, voltage, frequency) delivered to a corresponding electric motor or actuator. Each first equipment controller 312 may be further operable to calculate or determine torque generated or output by a corresponding electric motor, such as based on the electrical power (e.g., current, voltage, frequency) delivered to the electric motor. Thus, the first equipment controller 312 associated with the top drive 116 may be operable to output or otherwise facilitate torque sensor data indicative of torque output to the drill string 120 by the top drive 116. The first equipment controller 312 associated with the drawworks 118 may be operable to output or otherwise facilitate torque sensor data indicative of tension imparted to the traveling block 113 and the top drive 116. The first equipment controllers 312 may be communicatively connected with one or more of the other equipment controllers 310 and operable to output the torque sensor data to one or more of the other equipment controllers 310. Each first equipment controller 312 may be further operable to output or otherwise facilitate rotational speed and/or acceleration sensor data (e.g., sensor signals or measurements) indicative of operating speed and/or acceleration of a corresponding one of the top drive 116, the drawworks 118 and the mud pumps 144. The first equipment controllers 312 may be example implementations of the local controllers 221-227 of the control system 200 shown in FIG. 2.

A second control level may comprise a plurality of second equipment controllers 314 (i.e., local controllers, direct controllers), such as, for example, PLCs operable to control electric motors or other actuators of a corresponding piece of equipment or a corresponding common equipment system. The second equipment controllers 314 may be imparted with and operable to execute program code instructions, such as rigid computer programing. The second equipment controllers 314 may be local equipment controllers, each disposed in association with the one or more pieces of equipment the second equipment controller 314 controls. Each second equipment controller 314 may be communicatively connected with one or more corresponding first equipment controllers 312 and operable to receive the rotational sensor data, the torque sensor data, and other sensor data from the corresponding first equipment controllers 312 and output control data (e.g., control commands or signals) to the corresponding first equipment controllers 312 to control the rotational position, rotational distance, rotational speed, and/or torque of the motor of a corresponding one of the top drive 116, the drawworks 118, and the mud pumps 144. Each second equipment controller 314 may be communicatively connected with the sensors 186, 302, 304, 306, 308 of a corresponding one of the drill string 120, the top drive 116, the drawworks 118, and the mud pumps 144 and operable to receive sensor data output by the sensors 186, 302, 304, 306, 308. The second equipment controllers 314 may have or operate at a sampling rate between about ten hertz (Hz) and about one kilohertz (kHz). The second equipment controllers 314 may be example implementations of the local controllers 221-227 of the control system 200 shown in FIG. 2.

A third control level may comprise a third equipment controller 316 (i.e., central controller, a coordinated controller), such as, for example, a PC, an IPC, and/or another processing device. The third equipment controller 316 may be imparted with and operable to execute program code instructions, including high level programming languages, such as C, and C++, among other examples, and may be used with program code instructions running in a real time operating system (RTOS). The third equipment controller 316 may be a system-wide controller operable to control a plurality of devices and/or subsystems of the well construction system 100. The third equipment controller 316 may be communicatively connected with the second equipment controllers 314 and operable to receive sensor data from the first equipment controllers 312 via the second equipment controllers 314. The third equipment controller 316 may be operable to control the electric motors and actuators of different equipment systems via the first and second equipment controllers 312, 314. For example, the third equipment controller 316 may be operable to control the electric motors and actuators of the top drive 116 of the rotation system 301, the drawworks 118 of the hoisting system 303, and the mud pumps 144 of the circulation system 305. The third equipment controller 316 may be operable to control actuators of the drill string 120. The third equipment controller 316 may be operable to output control signals or information to the first equipment controllers 312 via the second equipment controllers 314 to control the rotational position, rotational distance, rotational speed, and/or torque of the top drive 116, the drawworks 118, and the mud pumps 144. The third equipment controller 316 may be communicatively connected with the sensors 186, 302, 304, 306, 308 and operable to receive the sensor data output by the sensors 186, 302, 304, 306, 308. The third equipment controller 316 may have or operate at a sampling rate between about ten Hz and about 100 Hz. The third equipment controller 316 may be or form at least a portion of the central controller 192 of the control system 200 shown in FIG. 2.

A fourth control level may comprise a fourth equipment controller 318 (i.e., an orchestration controller), such as, for example, a PC, an IPC, and/or another processing device. The fourth equipment controller 318 may be imparted with and operable to execute program code instructions, including orchestration software for high-level control of the drilling operations of the well construction system 100. The fourth equipment controller 318 may be operable to control the top drive 116, the drawworks 118, and the mud pumps 144 via the first, second, and third equipment controller 312, 314, 316. The fourth equipment controller 318 may be communicatively connected with the third equipment controller 316 and operable to receive torque and other measurements from the first equipment controllers 312 via the second and third equipment controllers 314, 316. The fourth equipment controller 318 may be operable to output control signals or information to the first equipment controller 312 via the second and third equipment controllers 314, 316 to control the rotational position, rotational distance, rotational speed, and/or torque of the top drive 116, the drawworks 118, and the mud pumps 144. The fourth equipment controller 318 may have or operate at a sampling rate ranging from about one or several seconds to about one or several minutes. The fourth equipment controller 318 may be or form at least a portion of the central controller 192 of the control system 200 shown in FIG. 2.

Figure 6:
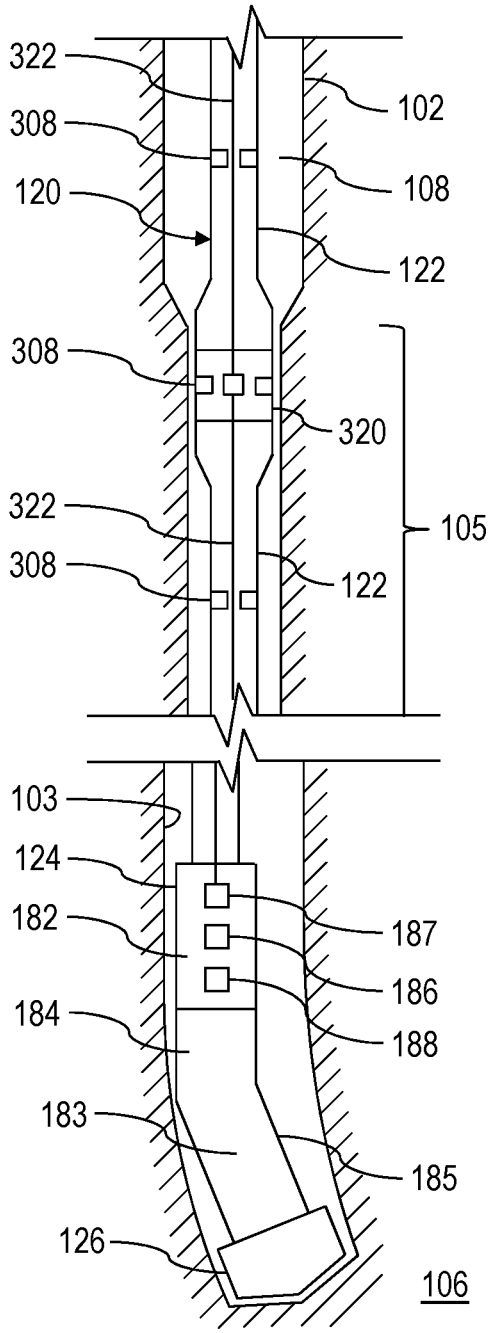
FIG. 6 is a schematic view of at least a portion of an example implementation of apparatus according to one or more aspects of the present disclosure.

FIG. 6 is a schematic view of the drill string 120 shown in FIG. 3 extending within a narrow portion 105 of the wellbore 102 according to one or more aspects of the present disclosure. The control system 300 shown in FIG. 3 may be further operable to detect presence and location of the narrow portion 105 of the wellbore 102. Narrow wellbore portions can cause a drill string to become stuck, which is known in the oil and gas industry as a stuck pipe event. To detect the narrow wellbore portion 105, the control system 300 may monitor distributed annular sensor data (e.g., annular fluid pressure data, annular fluid flow rate data) output by distributed downhole sensors 308 (e.g., fluid flow rate sensors, pressure sensors) along the drill string 120 and, based on such sensor data, determine if the corresponding sensor(s) is/are located within the narrow wellbore portion 105. Because fluid pressure is inversely proportional to flow rate of the fluid, a change in fluid pressure, equivalent circulation density, and/or flow rate may be indicative of the narrow wellbore portion 105. For example, a sudden or otherwise unexpected drop in annular pressure or equivalent circulation density, and/or a sudden or otherwise unexpected increase in annular fluid flow rate detected along a portion of the wellbore 102 based on sensor data output by one or more distributed sensors 308 may be indicative of a higher velocity fluid flow and, thus, a narrow wellbore portion surrounding a segment of the drill string 120 comprising such one or more distributed sensors 308.

Figure 7:
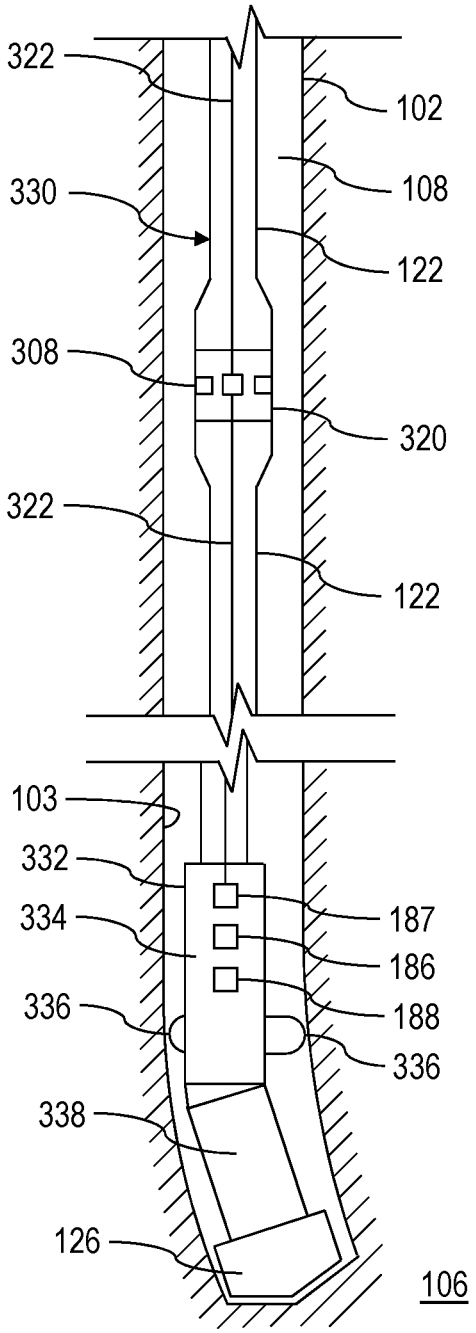
FIG. 7 is a schematic view of at least a portion of an example implementation of apparatus according to one or more aspects of the present disclosure.

FIG. 7 is a schematic view of at least a portion of an example implementation of a drill string 330 terminating with a BHA 332 comprising a drill bit 126, a mud motor 338, and a rotary steering tool 334 operable to steer or otherwise control the trajectory of the drill string 330 during drilling operations according to one or more aspects of the present disclosure. The drill string 330 may form a portion of or operate in conjunction with the well construction system 100 shown in FIG. 1 and may be monitored and controlled by the control system 300 shown in FIG. 3. The drill string 330 may comprise one or more features of the drill string 120 shown in FIGS. 1 and 3, including when identified by the same reference numerals. Accordingly, the following description refers to FIGS. 1, 3, and 7, collectively.

The rotary steering tool 334 may comprise a plurality of actuators 336, each operable to extend radially outwards from a body of the rotary steering tool 334 against the sidewall 103 of the wellbore 102 to move or urge radial (e.g., perpendicular, lateral) movement of the rotary steering tool 334 to change direction angle (i.e., orientation) of the mud motor 338 and drill bit 126, to change the trajectory of the drill string 330 advancing through the formation 106. The rotary steering tool 334 may comprise one or more sensors 186 operable to output sensor data indicative of operational parameters of the rotary steering tool 334. For example, the sensors 186 may comprise position sensors operable to output sensor data indicative of amount of radial movement or position of the actuators 336. The sensors 186 may also or instead comprise a navigation sensor operable to output sensor data indicative of trajectory, orientation, and/or position of the BHA 332 of the drill string 330. The rotary steering tool 334 or another portion of the BHA 332 may comprise a telemetry device 187 operable for communication with the equipment controllers 310 at the wellsite surface 104 via the electrical conductors 322 extending through the drill string 330. The rotary steering tool 334 or another portion of the BHA 332 may comprise a downhole controller 188 (e.g., a processing device) operable to receive, process, and/or store information received from the equipment controllers 310 and the sensors 186, and/or control the operation of the actuators 336 to control trajectory of the drill string 330 through the formation 106 during drilling operations. The downhole controller 188 may utilize the actuator position sensor data as feedback to control the position of the actuators 336 as part of a fast control loop.

Figure 8:
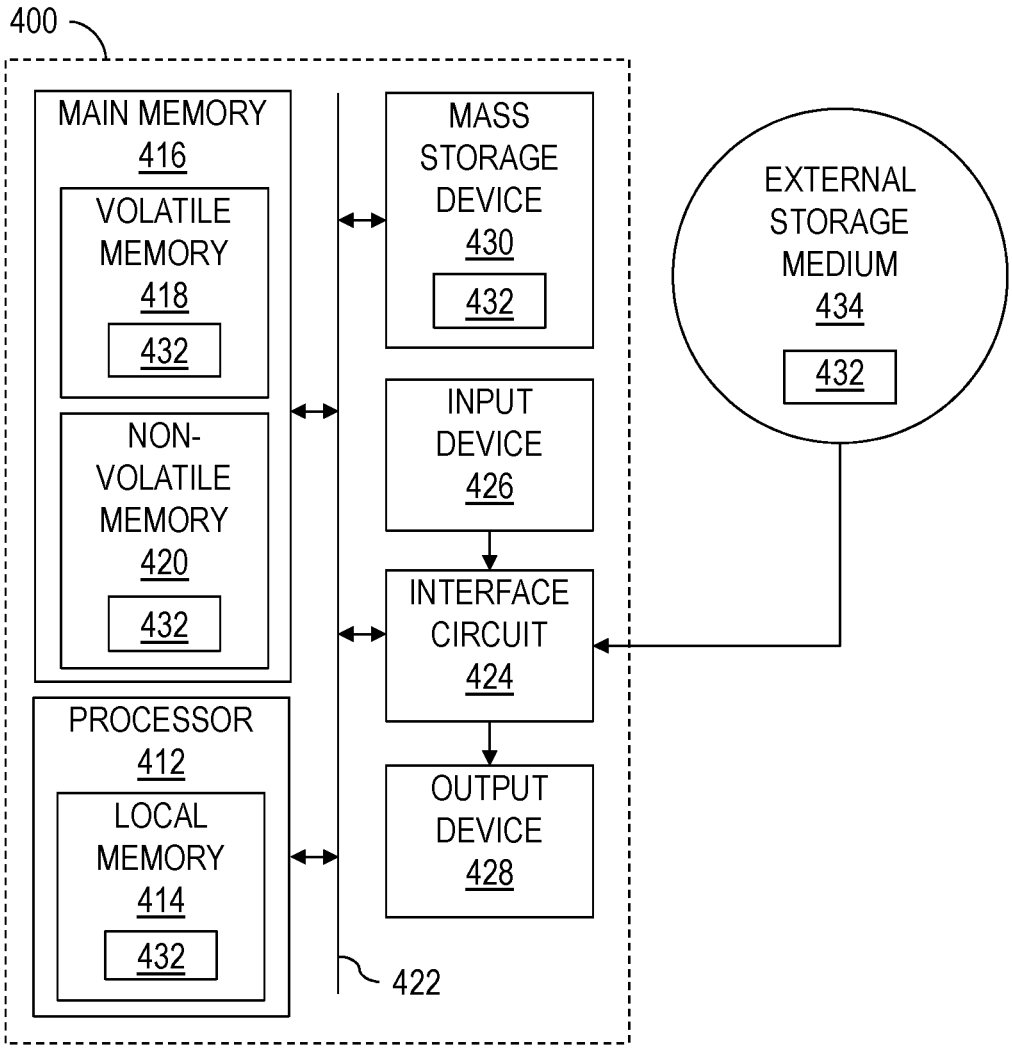
FIG. 8 is a schematic view of at least a portion of an example implementation of apparatus according to one or more aspects of the present disclosure.

FIG. 8 is a schematic view of at least a portion of an example implementation of a processing device 400 (or system) according to one or more aspects of the present disclosure. The processing device 400 may be or form at least a portion of one or more equipment controllers and/or other electronic devices shown in one or more of the FIGS. 1-7. Accordingly, the following description refers to FIGS. 1-8, collectively.

The processing device 400 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing device 400 may be or form at least a portion of the downhole controller 188 shown in FIGS. 1, 3, 6, 7. The processing device 400 may be or form at least a portion of the central controller 192 shown in FIGS. 1 and 2. The processing device 400 may be or form at least a portion of the local controllers 221-228 shown in FIG. 2. The processing device 400 may be or form at least a portion of the equipment controllers 312, 314, 316, 318 shown in FIG. 3. Although it is possible that the entirety of the processing device 400 is implemented within one device, it is also contemplated that one or more components or functions of the processing device 400 may be implemented across multiple devices, some or an entirety of which may be at the wellsite and/or remote from the wellsite.

The processing device 400 may comprise a processor 412, such as a general-purpose programmable processor. The processor 412 may comprise a local memory 414, and may execute machine-readable and executable program code instructions 432 (i.e., computer program code) present in the local memory 414 and/or another memory device. The program code instructions 432, when executed by the processor 412 of the processing device 400, may cause the processor 412 to receive and process sensor data (e.g., sensor measurements), and output control data (e.g., control commands) to one or more portions or pieces of well construction equipment of the well construction system 100 to implement example methods, processes, and/or operations described herein. For example, the program code instructions 432, when executed by the processor 412 of the processing device 400, may cause the top drive 116, the drawworks 118, the pumps 144, and the BHA 124, 332 to perform example methods and/or operations described herein.

The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 412 include one or more INTEL microprocessors, microcontrollers from the ARM and/or PICO families of microcontrollers, embedded soft/hard processors in one or more FPGAs.

The processor 412 may be in communication with a main memory 416, such as may include a volatile memory 418 and a non-volatile memory 420, perhaps via a bus 422 and/or other communication means. The volatile memory 418 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The processing device 400 may also comprise an interface circuit 424, which is in communication with the processor 412, such as via the bus 422. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may comprise a graphics driver card. The interface circuit 424 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 400 may be in communication with various sensors, video cameras, actuators, processing devices, equipment controllers, and other devices of the well construction system via the interface circuit 424. The interface circuit 424 can facilitate communications between the processing device 400 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 426 may also be connected to the interface circuit 424. The input devices 426 may permit rig personnel to enter the program code instructions 432, which may be or comprise control data, operational parameters, operational set-points, a well construction drill plan, and/or database of operational sequences. The program code instructions 432 may further comprise modeling or predictive routines, equations, algorithms, processes, applications, and/or other programs operable to perform example methods and/or operations described herein. The input devices 426 may be, comprise, or be implemented by a keyboard, a mouse, a joystick, a touchscreen, a track-pad, a trackball, an isopoint, and/or a voice recognition system, among other examples. One or more output devices 428 may also be connected to the interface circuit 424. The output devices 428 may permit for visualization or other sensory perception of various data, such as sensor data, status data, and/or other example data. The output devices 428 may be, comprise, or be implemented by video output devices (e.g., an LCD, an LED display, a CRT display, a touchscreen, etc.), printers, and/or speakers, among other examples. The one or more input devices 426 and the one or more output devices 428 connected to the interface circuit 424 may, at least in part, facilitate the HMIs described herein.

The processing device 400 may comprise a mass storage device 430 for storing data and program code instructions 432. The mass storage device 430 may be connected to the processor 412, such as via the bus 422. The mass storage device 430 may be or comprise a tangible, non-transitory storage medium, such as a floppy disk drive, a hard disk drive, a compact disk (CD) drive, and/or digital versatile disk (DVD) drive, among other examples. The processing device 400 may be communicatively connected with an external storage medium 434 via the interface circuit 424. The external storage medium 434 may be or comprise a removable storage medium (e.g., a CD or DVD), such as may be operable to store data and program code instructions 432.

As described above, the program code instructions 432 may be stored in the mass storage device 430, the main memory 416, the local memory 414, and/or the removable storage medium 434. Thus, the processing device 400 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code instructions 432 (i.e., software or firmware) thereon for execution by the processor 412. The program code instructions 432 may include program instructions or computer program code that, when executed by the processor 412, may perform and/or cause performance of example methods, processes, and/or operations described herein.

The present disclosure is further directed to systems and methods (e.g., operations, processes) for performing various downhole operations, such as drilling (e.g., rotary drilling, slide drilling) operations and tripping operations, according to one or more aspects of the present disclosure. The example methods described herein may be performed utilizing or otherwise in conjunction with at least a portion of one or more implementations of one or more instances of the apparatus shown in one or more of FIGS. 1-8, and/or otherwise within the scope of the present disclosure. The methods may be performed and/or caused, at least partially, by the control system 300 executing program code instructions according to one or more aspects of the present disclosure. The electrical conductor 322 (e.g., WDP electrical conductor) can facilitate transmission of the distributed and other downhole sensor data at a high transfer rate (e.g., bandwidth) and speed to one or more of the equipment controllers 310 at the wellsite surface. The sensor data can then be analyzed by one or more of the equipment controllers 310 to optimize the drilling and tripping operations. Thus, the present disclosure is also directed to a non-transitory, computer-readable medium comprising computer program code that, when executed by a processing device, may cause such processing device to perform the example methods described herein. The methods may also or instead be performed and/or caused, at least partially, by rig personnel (i.e., a human wellsite operator) utilizing one or more instances of the apparatus shown in one or more of FIGS. 1-8, and/or otherwise within the scope of the present disclosure. Thus, the following description of example methods refers to apparatus shown in one or more of FIGS. 1-8. However, the methods may also be performed in conjunction with implementations of apparatus other than those depicted in FIGS. 1-8 that are also within the scope of the present disclosure.

An aspect of the present disclosure is directed to various methods, operations, and/or processes (collectively referred to hereinafter a "methods) for monitoring and controlling slide drilling operations by monitoring and controlling orientation of the mud motor toolface 185 and/or reducing axial friction between the drill string 120 and the sidewall 103 of the wellbore 102 to increase the ROP through the formation 106. The control system 300 may be operable to monitor and control the rotation system 301, the hoisting system 303, and the circulation system 305 to perform directional drilling by selectively lifting the top drive 116 and the drill string 120 via the drawworks 118, and rotating the drill string 120 and/or the drill bit 126 via the top drive 116 and/or the mud motor 184, respectively. Thus, during slide drilling operations, the control system 300 may receive and process various distributed or other downhole sensor data generated by the downhole sensors 186, 308 to monitor and control the slide drilling operations. The sensor data may be transmitted to one or more of the equipment controllers 310 via the electrical conductors 305, 322.

During non-directional drilling operations, known in the oil and gas industry as "rotary drilling," both the top drive 116 and the mud motor 184 rotate the drill bit 126 resulting in a total drill bit rotational rate that is equal to the rotational rates of both the top drive 116 and the mud motor 184. To cause the drill string 120 to drill in an intended lateral direction (i.e., to turn), the top drive 116 stops rotating and orients the motor toolface 185 and, thus, the drill bit 126 in an intended direction. The mud motor 184 may then continue to rotate the drill bit while WOB is controlled by the drawworks 118, thereby causing the drill string 120 to advance in the intended direction through the formation 106 forming the wellbore 102. Directional drilling performed while the drill bit 126 is oriented in the intended direction by the top drive 116 and rotated by the mud motor 184 is known in the oil and gas industry as "slide drilling." Rotary and slide drilling operations may be alternated periodically to steer the drill string 120 to form a deviated wellbore 102 along a predetermined trajectory (i.e., path) through the formation 106. Typically, an entire wellbore 102 can be drilled through a combination of rotary drilling (with higher ROP, but no control over wellbore trajectory) and slide drilling (with lower ROP, but with control of the wellbore trajectory).

During slide drilling, at least a portion of the BHA 124 and/or the conveyance means 122, opposite the direction of the motor toolface 185, slides along a sidewall 103 of the wellbore 102. Thus, during slide drilling, a reduced amount of drill string weight is transferred to the drill bit 126 because of axial friction between the sidewall 103 of the wellbore 102 and the drill string 120. A reduced weight-on-bit results in a reduced axial contact force between the drill bit 126 and the formation 106 (i.e., rock) being cut by the drill bit 126, resulting in a reduced ROP through the formation 106. The control system 300 may be operated to cause the top drive 116 to rotate the drill string 120 in alternating (i.e., opposite) rotational directions in an oscillating manner to lower the axial friction between the drill string 120 and the sidewall 103 of the wellbore 102, thereby increasing weight transfer to the drill bit 126, resulting in a higher ROP, while also controlling directional orientation of the motor toolface 185. Thus, the control system 300 may be operated to cause the top drive 116 to rotate the drill string 120 in alternating (i.e., opposite) rotational directions in an oscillating manner to control orientation (i.e., rotational or angular direction) of the toolface 185 of the mud motor 184 to control (i.e., steer) the trajectory of the drill string 120 and, thus, the wellbore 102.

To control the surface oscillations, an accurate measure of the surface torque or rotation is obtained to rotate the drill string 120. One way this can be achieved is by taking values of surface torque or rotation when initiating rotation off-bottom. When doing so, an estimate of when the entire drill string 120 has begun rotation is also obtained. Such process can be optimized by monitoring propagation of distributed downhole torque and/or rotation (e.g., rotational speed and/or rotational orientation) along the drill string 120 by monitoring distributed downhole torque and/or rotation sensor data generated by the distributed sensors 308 distributed along the drill string 120 and transmitted to the equipment controllers 310 via the electrical conductor 322.

Currently, rig personnel and surface control systems have limited feedback indicative of the operational status of mud motor and other downhole operational parameters or conditions while performing slide drilling operations. Namely, the rig personnel and current surface control systems receive surface pressure measurements (which can be used to estimate the WOB and torque at drill bit (TAB)) and, intermittently (e.g., about every 30-60 seconds) receive downhole toolface orientation measurements via mud-pulse telemetry or electromagnetic telemetry. However, the electrical conductor 322 according to one or more aspects of the present disclosure permits the rig personnel 195 and the equipment controllers 310 of the control system 300 to receive downhole toolface orientation sensor data at a high transfer rate and from multiple locations along the drill string 120 via the distributed downhole sensors 308, and analyze the propagation of the torque and rotation applied at the surface by the top drive 116 along the drill string 120 via torque and rotation sensor data received from the distributed downhole sensors 308 at a high transfer rate via the electrical conductor 322. The equipment controllers 310 may also receive and analyze axial load and internal pressure (within the fluid passage 122 of the drill string 120) sensor data at a high transfer rate via the electrical conductor 322 from the distributed sensors 308 at multiple depths along the drill string 120.

One or more of the equipment controllers 310 (e.g., the equipment controller 316) may receive the downhole sensor data and modify operational parameters of the oscillations imparted to the drill string 120 by the top drive 116 based on the received sensor data. The rig personnel may instead manually control the top drive 116 based on the received and displayed sensor data to modify the operational parameters of the oscillations. For example, if the surface torque and/or rotational oscillations are propagating a short distance along the drill string 120, the amplitude of the surface torque and/or rotational oscillations can be increased in amplitude. However, if the surface torque and/or rotational oscillations are causing unintended changes to the orientation of the toolface 185 of the mud motor 184, the amplitude of the surface torque and/or rotational oscillations can be decreased. As described above, the downhole sensor data can be transmitted to the equipment controllers 310 via the electrical conductor 322, thereby facilitating a fast detection and response to unintended torque and/or rotational oscillations at the toolface 185. Furthermore, one or more of the equipment controllers 310 or the rig personnel may modulate operation of the drawworks 118 and/or the pumps 144 to achieve an intended TAB, axial load at bit, and pressure of drilling fluid at the mud motor 184 while performing the slide drilling operations.

Methods according to one or more aspects of the present disclosure may thus comprise generating downhole rotational orientation sensor data indicative of rotational orientation of a drill string 120 at a plurality of different depths of the wellbore 102 via a plurality of rotation sensors 308 distributed at different axial locations along the drill string 120, and transmitting the downhole rotational orientation sensor data to surface wellsite equipment (e.g., one or more of the equipment controllers 310) via an electrical conductor 322 extending along the drill string 120. The method may further comprise controlling a top drive 116 to impart rotational oscillations to the drill string 120 based on the downhole rotational orientation sensor data.

Methods may also comprise performing the slide drilling operations with a WDP string 120 in an oil and/or gas well 102, including imparting rotational oscillations to the WDP string 120 by controlling a top drive 116 based on downhole data received by surface wellsite equipment (e.g., one or more of the equipment controllers 310) via electrical conductors 322 integral to WDP 122 of the WDP string 120. Controlling the top drive 116 may comprise controlling the top drive 116 to maximize the imparted rotational oscillations while minimizing rotational oscillations of the motor toolface 185.

The received downhole data may comprise downhole rotational orientation data that is generated by a plurality of rotation sensors 308 distributed axially along the WDP string 120, and indicative of rotational orientation of different sections of the WDP string 120. The downhole rotational orientation sensor data may be indicative of rotational orientation of a plurality of WDP sections 122 of the WDP string 120 and rotational orientation of a toolface 185 of a mud motor 184 of the WDP string 120. The received downhole data may further comprise downhole torque data that is generated by a plurality of torque sensors 308 distributed axially along the WDP string 120 and indicative of torque transmitted through of various sections 122 of the WDP string 120. The received downhole data may comprise downhole axial load data that is generated downhole by an axial load sensor 186 and indicative of axial load applied to a drill bit 126 of the WDP string 120. Thus, performing the slide drilling operations may further comprise vertically moving the WDP string 120 by controlling a drawworks 118 based on the downhole axial load data received by the surface wellsite equipment via the electrical conductors 322. The received downhole data may further comprise downhole pressure data that is generated downhole by a pressure sensor 186 and indicative of pressure of the drilling fluid in an internal passage 121 of the WDP string 120. Thus, performing the slide drilling operations further comprises pumping the drilling fluid through the internal passage 121 by controlling mud pumps 144 based on second downhole data received by the surface wellsite equipment via the electrical conductors 322, wherein controlling the mud pumps 144 may be based on TAB of the WDP string 120 determined by the surface wellsite equipment based on the received downhole pressure data.

Methods according to one or more aspects of the present disclosure may also comprise, while performing drilling operations of an oil and gas well 102 via a top drive 116 and a mud motor 184, generating via a downhole pressure sensor 186 downhole pressure sensor data indicative of pressure of drilling fluid being pumped downhole through an internal fluid passage 121 of a drill string 120, and transmitting the downhole pressure sensor data to surface wellsite equipment (e.g., one or more of the equipment controllers 310) via an electrical conductor 322 extending along the drill string 120. The method may further comprise determining TAB by the surface wellsite equipment 310 based on the downhole pressure sensor data. The method may also comprise controlling speed of a drawworks 118 to control or otherwise change vertical speed of the drill string 120 based on the downhole pressure sensor data and/or on the determined TAB. The mud pumps 144 for pumping the drilling fluid through the internal fluid passage 121 of the drill string 120 may also or instead be controlled to adjust flow rate of the drilling fluid based on the downhole pressure sensor data and/or on the determined TAB.

Methods may also comprise performing the slide drilling operations with a WDP string 120 in an oil and/or gas well 102, including by pumping drilling fluid to a mud motor 184 of the WDP string 120 through an internal passage 121 of the WDP string 120 and vertically moving the WDP string 120 via a drawworks 118 while controlling the drawworks 118 to change vertical speed of the WDP string 120 based on downhole data received by surface equipment (e.g., one or more of the equipment controllers 310) and/or based on information that is determined by the surface wellsite equipment 310 based on downhole data received by the surface wellsite equipment 310 via electrical conductors 322 integral to WDP 122 of the WDP string 120.

The received downhole data may comprise downhole pressure data that is generated downhole by a pressure sensor 186 and is indicative of pressure of the drilling fluid in the internal passage 121. The pressure sensor 186 may be disposed within a bottom-hole assembly (BHA) 124 of the WDP string 120 or connected with a WDP section 122 of the WDP string 120. The determined information may thus comprise TAB of the WDP string 126 calculated based on pressure in the internal passage 121 at the mud motor 184 and operational (e.g., structural) specifications of the mud motor 184. The drilling fluid pressure determined based on the downhole pressure data may refer to a differential pressure between the pressure in the internal passage 121 at the mud motor 184, which may be captured by an internal pressure sensor 186 (e.g., having one or more features of an internal pressure sensor 308 shown in FIG. 5), and wellbore pressure external to the mud motor 184, which may be captured by an external pressure sensor 186 (e.g., having one or more features of an external pressure sensor 308 shown in FIG. 5). Furthermore, the downhole pressure determined based on the downhole pressure data may be compared to a reference downhole pressure determined while the drill bit is off-bottom. In other words, the determined downhole pressure may be or comprise a difference in pressure taken during drilling operations and pressure taken while off-bottom or otherwise not drilling, but still flowing drilling fluid via the internal passage 121.

The received downhole data may also or instead comprise downhole axial load data that is generated downhole by an axial load sensor 186 and indicative of axial load applied to a drill bit 116 of the WDP string 120. Accordingly, performing the slide drilling operations may further comprise vertically moving the WDP string 120 while controlling speed of the drawworks 118 to change vertical speed of the WDP string 120 based on the downhole axial load data received by the surface wellsite equipment 310 via the electrical conductors 322.

Methods according to one or more aspects of the present disclosure may also comprise, while performing slide drilling operations of an oil and gas well 102, generating downhole rotational orientation sensor data indicative of rotational orientation of a drill string 120 at a plurality of different depths of the well 102 via a plurality of rotation sensors 308 distributed at different axial locations along the drill string 120, and generating downhole torque sensor data indicative of torque being transmitted through the drill string 120 at a plurality of different depths of the well 102 via a plurality of torque sensors 308 distributed at different axial locations along the drill string 120. The method may further comprise transmitting the downhole rotational orientation sensor data and the downhole torque sensor data to a processing device (e.g., one or more of the equipment controllers 310) at a wellsite surface 104 via an electrical conductor 322 extending along the drill string 120, operating the processing device 310 to generate a mathematical model of a downhole system based at least partially on the downhole rotational orientation sensor data and the downhole torque sensor data, and controlling a top drive 116 to impart rotational oscillations to the drill string based on the downhole rotational orientation sensor data and the mathematical model.

Methods may also comprise performing slide drilling operations with a WDP string 120 in an oil and/or gas well 102, including imparting rotational oscillations to the WDP string by controlling a top drive based on downhole rotational orientation data and a mathematical model of a downhole system. The downhole rotational orientation data may be generated by rotation sensors 308 distributed axially along the WDP string 120, indicative of rotational orientation of different first sections of the WDP string 120, and received by surface wellsite equipment (e.g., one or more of the equipment controllers 310) via electrical conductors 322 integral to WDP 122 of the WDP string 120. The mathematical model of the downhole system may be generated by the surface wellsite equipment 310 based at least partially on the received downhole rotational orientation data and downhole torque data. The downhole torque data may be generated by torque sensors 308 distributed axially along the WDP string 120, indicative of torque transmitted through the different first sections 122 and/or different second sections 122 of the WDP string 120, and received by the surface wellsite equipment 310 via the electrical conductors. The downhole rotational orientation sensor data may be indicative of rotational orientation of a plurality of WDP sections 122 of the WDP string and rotational orientation of a toolface 185 of a mud motor 184 of the WDP string 120. The top drive 116 may be controlled to maximize the imparted rotational oscillations while minimizing rotational oscillations of the motor toolface 185. The downhole system may comprise at least one of the WDP string 120, a sidewall 103 of the well 102, and wellbore fluid between the sidewall 103 and the WDP string 120. The mathematical model may describe properties at different axial locations along the WDP string 120. The properties may comprise at least one of mechanical properties of the WDP string 120, friction properties between the wellbore fluid and the WDP string 120, and friction properties between the sidewall 103 and the WDP string 120.

The control system 300 may be further operable to automatically control vertical movement of the drill string 120. For example, rotational speed of the drawworks 118 may be modified in an attempt to achieve intended WOB, TAB, mud motor pressure drop, and/or ROP. Current control systems monitor various sensor data output by sensors located at the wellsite surface to predict downhole operational parameters and conditions. The electrical conductor 322 extending along the drill string 120 can transfer downhole sensor data output by downhole sensors 186 to surface wellsite equipment 310, which may monitor and use such downhole sensor data (e.g., WOB, drill bit speed, TAB, internal drilling fluid pressure) as a basis for controlling the drawworks 118 to achieve the intended WOB, TAB, mud motor pressure drop, and/or ROP. The downhole sensor data may be used to generate a model of the mud motor power curve, which may be used to control various drilling operational parameters to avoid stalling of the mud motor 184 and optimize performance of the mud motor 184.

Methods according to one or more aspects of the present disclosure may thus comprise, while performing drilling operations of an oil and gas well 102, generating downhole axial load sensor data indicative of axial load being transmitted to a drill bit 126 of a drill string 120 via a downhole axial load sensor 186 and transmitting the downhole axial load sensor data to surface wellsite equipment, such as the equipment controllers 310, via an electrical conductor 322 extending along the drill string 120. The method may further comprise controlling a drawworks 118 for vertically moving the drill string 120 based on the downhole axial load sensor data.

Methods may further comprise performing slide drilling operations with a WDP string 120 in an oil and/or gas well 102, including vertically moving the WDP string 120 by controlling a drawworks 118 based on downhole data received by the surface wellsite equipment 310 via electrical conductors 322 integral to WDP 122 of the WDP string 120. The received downhole data may comprise downhole axial load data that is generated downhole by an axial load sensor 186 and indicative of axial load applied to a drill bit 126 of the WDP string 120. The received downhole data may further comprise downhole torque data that is generated downhole by a torque sensor 186 and indicative of TAB. Thus, controlling the drawworks 118 may be further based on the downhole torque data.

Methods may also comprise pumping drilling fluid to a mud motor 184 of the WDP string 120 through an internal passage 121 of the WDP string 120 by controlling fluid pumps 144 based on the information that is determined by the surface wellsite equipment 310 based on the downhole data received by the surface wellsite equipment 310. The received downhole data may comprise downhole pressure data that is generated downhole by a pressure sensor and is indicative of pressure of the drilling fluid in the internal passage and the determined information may comprise TAB of the WDP string 120. Thus, controlling the drawworks 118 may be further based on the determined TAB.

During drilling operations, a drill string may experience stick-slip motion, whereby a drill bit stops rotating (sticks) in a wellbore, such as due to friction, while top of the drill string continues to be rotated by a top drive or another driver, thereby twisting the drill string. When the drill bit becomes free and rotates again (slips), it accelerates to a rotational speed that may be higher than the rotational speed of the top of the drill string. Such stick-slip motion may cause rotational (i.e., torsional) waves (e.g., oscillations, vibrations) that propagate or otherwise travel in an upward (i.e., uphole) and/or downward (i.e., downhole) directions along the drill string while the drill string is rotated within the wellbore. Stick-slip motion and the resulting rotational waves in the drill string are a recognized problem in the drilling industry and may result in a reduced ROP through the subterranean formation, bit wear, torsional damage to the drill string, failures or damage to the surface driver, and/or other damage to drilling equipment.

Another aspect of the present disclosure is directed to various implementations of systems and methods (e.g., processes, operations) for monitoring and controlling drilling operations to increase performance (e.g., increase ROP) of the drilling operations, such as by reducing stick-slip. Systems and methods according to one or more aspects of the present disclosure may be directed to a control system 300 for controlling a top drive 116 operable to rotate a drill string 120 to form a wellbore 102 extending into a subterranean formation 106. The control system 300 may comprise one or more equipment controllers 310 (e.g., one or more of the equipment controllers 314, 316), each comprising a processor and a memory storing executable program code instructions comprising a stick-slip algorithm, which when executed by the processor of the equipment controllers 310, may cause the equipment controllers 310 to receive downhole sensor data indicative of operational status of the drill string 120. During drilling operations, the equipment controllers 310 may be further caused to output control data (i.e., control commands) based on the stick-slip algorithm and the downhole sensor data, thereby causing the top drive 116 to vary rotational speed of the drill string 120 to reduce rotational waves traveling along the drill string 120.

An electrical conductor 322 extending through the drill string 120 (e.g., a WDP string) can be used to transmit downhole sensor data indicative of downhole operational status (e.g., magnitude and speed of torsional and/or rotational oscillations) from a downhole sensor 186 at a BHA 124 and/or a plurality of distributed downhole sensors 308 located along the drill string 120 to the equipment controllers 310 at the wellsite surface to improve performance of surface stick-slip mitigation. For example, downhole rotational speed sensor data output by the downhole sensor 186 located in the BHA 124 may be transmitted to the equipment controllers 310 via the electrical conductor 322 and, thereby, facilitate real-time rotational speed feedback indicative of effectiveness (e.g., efficiency) of the stick-slip mitigation. Such real-time rotational speed feedback may permit the equipment controllers 310 or the rig personnel 195 to modify control parameters (e.g., stick-slip parameters, control coefficients, filtering frequencies) and receive feedback on whether the stick-slip mitigation improves or worsens with the new parameters used by the equipment controllers 310. The real-time rotational speed feedback may also permit determination of the dominant frequency of the stick-slip motion experienced by the BHA 124, which can then be used to tune the control parameters.

Current control systems utilize torque and rotational speed sensor data from surface sensors to mitigate stick-slip motion. Performance of such control systems depend on a very fast reaction between the surface torque and rotational speed measurements and surface torque and speed modulation of the top drive. However, downhole torque and/or rotational speed sensor data from a plurality of distributed downhole sensors 308 located along the drill string 120 can be transmitted to one or more of the equipment controllers 310 (e.g., one or more of the equipment controllers 314, 316) in real-time via the electrical conductor 322, thereby permitting the equipment controllers 310 and/or the rig personnel 195 to anticipate arrival at the surface (e.g., at the top drive 116 or a rotary table and kelly assembly) of torque and/or rotational waves caused by the stick-slip of the drill bit 126. Knowing the time or otherwise when the torque and/or rotational waves arrive at the surface can improve reaction time by the top drive 116, such as by causing the top drive 116 to react (e.g., move to dampen a torque and/or rotational wave) at the same time or in advance to the arrival of the torque and/or rotational wave. In other words, the torque and/or rotational waves caused by stick-slip can be predicted in advance, because the downhole torque and/or rotational speed sensor data can be transmitted to the surface equipment controllers 310 via the electrical conductor 322 faster than the torque and/or rotational waves propagate to the surface.

Methods according to one or more aspects of the present disclosure may thus comprise, while performing drilling operations of an oil and gas well 102 via a drill string 120 that is experiencing stick-slip, generating rotational speed sensor data of the drill string 120 at a plurality of different depths of the well 102 via a plurality of rotation sensors 308 distributed at different axial locations along the drill string 120 and transmitting the rotational speed sensor data to surface wellsite equipment (e.g., one or more of the equipment controllers 310) via an electrical conductor 322 extending along the drill string 120. The method may further comprise controlling a top drive 116 to reduce the stick-slip based on the rotational speed sensor data.

Methods may also comprise performing drilling operations in an oil and/or gas well 102 with a WDP string 120 that is experiencing stick-slip, including reducing the stick-slip by controlling a top drive 116 based on downhole data received by surface wellsite equipment (e.g., one or more of the equipment controllers 310) via electrical conductors integral to WDP 122 of the WDP string 120. The received downhole data may comprise downhole rotational speed data that is generated by a plurality of rotation sensors 308 distributed axially along the WDP string 120 and indicative of rotational speed of different sections of the WDP string 120. Controlling the top drive 116 may cause dampening of the rotational oscillation of the stick-slip. The determined information may comprise frequency of the stick-slip determined based on the received downhole rotational speed data. Thus, controlling the top drive 116 to reduce the stick-slip may be further based on the determined frequency of the stick-slip. The determined information may also or instead comprise an amount of time for a rotational oscillation of the stick-slip to propagate to the top drive 116 based on the received downhole rotational speed data. Thus, controlling the top drive 116 to reduce the stick-slip is further based on the determined amount of time.

Current control systems utilize mathematical models of downhole fluid systems (e.g., drilling and formation fluid within a wellbore) and/or pressure data from surface sensors to predict fluid pressure distribution outside of the drill string at various depths of the wellbores being drilled. The mathematical models may comprise physical properties (e.g., flow, pressure) of wellbore fluid (e.g., drilling fluid, formation fluid, rock cuttings, etc.) column between the drill bit and the wellsite surface and may be analyzed by control systems prior to and/or during various drilling operations, such as managed pressure drilling, rotary drilling, and/or slide drilling. However, mathematical models of downhole fluid systems according to one or more aspects of the present disclosure may be generated based on distributed downhole pressure data from distributed downhole pressure sensors, thereby increasing accuracy and precision of the modeled physical properties of the downhole fluid systems. Accordingly, a control system according to one or more aspects of the present disclosure may utilize mathematical models based on the distributed downhole data to control managed pressure drilling, rotary drilling, and/or slide drilling operations with increased accuracy and precision and, thus, decreased chances of abnormal downhole events taking place during such drilling operations. Furthermore, because distributed downhole pressure data from the distributed downhole pressure sensors is available in real-time to a surface control system according to one or more aspects of the present disclosure, such control system may not utilize a mathematical model of the downhole fluid system, but control the drilling operations directly based on the distributed downhole pressure data.

Methods according to one or more aspects of the present disclosure may thus comprise, while performing drilling operations of an oil and gas well 102, generating wellbore pressure sensor data indicative of pressure of wellbore fluid outside of a drill string 120 at a plurality of different depths of the well 102 via a plurality of downhole pressure sensors 308 distributed at different axial locations along the drill string 120 and transmitting the wellbore pressure sensor data to surface wellsite equipment (e.g., one or more of the equipment controllers 310) via an electrical conductor 322 extending along the drill string 120. The method may further comprise controlling a choke manifold 152 (i.e., an MPD choke manifold) and/or mud pumps 144 for pumping the drilling fluid through the internal fluid passage 121 of the drill string 120 based on the wellbore pressure sensor data such that the pressure of the wellbore fluid is at an intended level.

Methods may further comprise performing drilling operations with a WDP string 120 in an oil and/or gas well 102, including pumping drilling fluid through an internal passage 121 of the WDP string 120 by controlling a choke manifold 152 and/or mud pumps 144 based on downhole data received by the surface wellsite equipment 310 via electrical conductors 322 integral to WDP 122 of the WDP string 120. The received downhole data may comprise wellbore pressure data that is generated by a plurality of pressure sensors 302 distributed axially along the WDP string 120 and indicative of pressure of wellbore fluid outside the WDP string 120. Controlling the mud pumps 144 may comprise maintaining the wellbore fluid outside the WDP string 120 at an intended pressure. Controlling the mud pumps 144 may be based on a mathematical model of wellbore fluid properties along the well 102. The mathematical model may describe wellbore fluid pressure distribution along the well 102 and/or may be generated by the surface wellsite equipment 310 based at least partially on the received wellbore pressure data.

Methods may still further comprise performing drilling operations with a WDP string 120 in an oil and/or gas well 102, including controlling drilling equipment 116, 118, 144 to control the drilling operations based on downhole data received by the surface wellsite equipment 310 via electrical conductors 322 integral to WDP 122 of the WDP string 120 and a mathematical model of a downhole system. The model may be generated by a processing system 400 of the surface wellsite equipment 310 based at least partially on the received downhole data, which may be generated by a plurality of sensors distributed axially along the WDP string 120 and be indicative of downhole properties.

Methods may also comprise, while performing drilling operations of an oil and gas well 102, generating downhole sensor data indicative of downhole properties at a plurality of different depths of the well 102 via a plurality of downhole sensors 308 distributed at different axial locations along the drill string 120, transmitting the downhole sensor data to a processing device 400 at a wellsite surface via an electrical conductor 322 extending along the drill string 120, and operating the processing device 400 to generate a mathematical model of a downhole system based at least partially on the downhole sensor data. Such method may further comprise controlling surface equipment 116, 118, 144 to control the drilling operations based at least partially on the downhole sensor data and the mathematical model.

The downhole system may comprise at least one of the WDP string 120, drilling fluid within the WDP string 120, physical properties of the well 102, and wellbore fluid surrounding the WDP string 120 in the well 102. The received downhole data may comprise at least one of downhole axial load data indicative of axial load transmitted by the WDP string 120, downhole torque data indicative of torque transmitted by the WDP string 120, downhole rotational orientation WDP data indicative of rotational orientation of the WDP string 120, downhole rotational speed data indicative of rotational speed of the WDP string 120, downhole pressure data indicative of pressure of wellbore fluid surrounding the WDP string 120, and downhole pressure data indicative of pressure of drilling fluid inside the WDP string. Accordingly, the mathematical model may describe at least one of axial load distribution along the WDP string 120, torque distribution along the WDP string 120, rotational speed distribution along the WDP string 120, pressure distribution of drilling fluid within the WDP string 120, pressure distribution of wellbore fluid surrounding the WDP string 120 in the well 102, and distribution of friction properties affecting the WDP string 120.

As described above, the control system 300 according to one or more aspects of the present disclosure may be further operable to detect presence and location of a narrow portion 105 of a wellbore 102. Narrow wellbore portions 105 can cause the drill string 120 to become stuck, which is known in the oil and gas industry as a stuck pipe event. To detect the narrow wellbore portion 105, the control system 300 may monitor distributed annular wellbore pressure data output by distributed pressure sensors 308 along the drill string 120 and, based on the annular pressure data, determine a change in annular pressure and/or equivalent circulation density. For example, a sudden or otherwise unexpected drop in annular pressure and/or equivalent circulation density detected along a portion of the wellbore 102 based on one or more annular pressure sensors 308 may be indicative of a higher velocity fluid flow and, thus, a narrow wellbore portion 105.

Methods according to one or more aspects of the present disclosure may thus comprise, while performing drilling operations of an oil and gas well 102, generating wellbore pressure sensor data indicative of pressure of wellbore fluid outside of a drill string 120 at a plurality of different depths of the well 102 via a plurality of downhole pressure sensors 308 distributed at different axial locations along the drill string 120 and transmitting the wellbore pressure sensor data to a processing device 400 at a wellsite surface 104 via an electrical conductor 322 extending along the drill string 120. The method may further comprise operating the processing device 400 to detect a narrow portion of the well 102 based on the wellbore pressure sensor data.

Methods may further comprise performing drilling operations with a WDP string 120 in an oil and/or gas well 102, including pumping drilling fluid through an internal passage 121 of the WDP string 120 via mud pumps 144 while surface wellsite equipment (e.g., one or more of the equipment controllers 310) receives downhole data via electrical conductors 322 integral to WDP 122 of the WDP string 120. The received downhole data may comprise downhole pressure data that is generated by a plurality of pressure sensors 308 distributed axially along the WDP string 120 and indicative of pressure of the drilling fluid surrounding the WDP string 120 in the well 102. Thus, the method may further comprise operating a processing device 400 of the surface wellsite equipment 310 to detect a narrow portion 105 of the well based on the received downhole pressure data. The surface wellsite equipment 310 may control the top drive 116, the drawworks 118, and/or the pumps 144 based on the downhole pressure data and/or the detected narrow portion 105 (e.g., vertical height (length) of the narrow portion 105, inside diameter (width) of the narrow portion 105), such as to reduce chances that the WDP string 120 becomes stuck in the narrow portion 105.

Detecting the narrow portion 105 of the well 102 may comprise detecting a well depth at which the received downhole pressure data is indicative of a lower pressure relative to pressure at other portions of the well 102, wherein the narrow portion 105 is located at the detected well depth. Detecting the narrow portion 105 may also or instead comprise detecting a well depth at which the received downhole pressure data is indicative of a lower pressure relative to pressure at other portions of the well 102. Detecting the narrow portion 105 may also or instead comprise detecting a well depth at which the received downhole pressure data is indicative of a lower equivalent circulating density relative to equivalent circulating density at other portions of the well 102, wherein the narrow portion 105 is located at the detected well depth.

As described above, current control systems utilize mathematical models of downhole fluid systems and/or pressure data from surface sensors to predict fluid pressure distribution outside of the drill string at various depths of the wellbores being drilled. The mathematical models may comprise physical properties (e.g., flow, pressure) of wellbore fluid column between the drill bit and the wellsite surface and may be analyzed by control systems prior to and/or during various downhole operations, such as drill string tripping operations. However, mathematical models of downhole fluid systems according to one or more aspects of the present disclosure may be generated based on distributed downhole pressure data from distributed downhole pressure sensors, thereby increasing accuracy and precision of the modeled physical properties of the wellbore fluid. Accordingly, a control system according to one or more aspects of the present disclosure may utilize mathematical models based on the distributed downhole data to control speed or rate of drill string tripping operations with increasing accuracy and precision and, thus, decreasing chances of abnormal downhole events, such as surge and swab, taking place during such tripping operations. Furthermore, because distributed downhole pressure data from distributed downhole pressure sensors is available in real-time to a surface control system according to one or more aspects of the present disclosure, such control system may not utilize a mathematical model of the downhole fluid system, but control the tripping operations directly based on the distributed downhole pressure data.

Methods according to one or more aspects of the present disclosure may thus comprise, while performing tripping operations of a drill string 120 into or out of an oil and gas well 102, generating wellbore pressure sensor data indicative of pressure of wellbore fluid outside of a drill string 120 at a plurality of different depths of the well 102 via a plurality of downhole pressure sensors 308 distributed at different axial locations along the drill string 120 and transmitting the wellbore pressure sensor data to surface wellsite equipment (e.g., one or more of the equipment controllers 310) via an electrical conductor 322 extending along the drill string 120. The method may further comprise controlling a drawworks 118 for moving the drill string 120 into and out of the well 102 based on the wellbore pressure sensor data.

Methods may further comprise performing tripping operations with a WDP string 120 within an oil and/or gas well 102, including moving the WDP string 120 within the well 102 by controlling a drawworks 118 based on downhole data received by the surface wellsite equipment 310 via electrical conductors 322 integral to WDP 122 of the WDP string 120. The received downhole data may comprise downhole pressure data that is generated by a plurality of pressure sensors 308 distributed axially along the WDP string 120 and indicative of pressure of drilling fluid surrounding the WDP string 120 in the well 102.

Controlling the drawworks 118 may also or instead comprise preventing the drawworks 118 from moving the WDP string 120 into the well 102 at a speed sufficient to cause a pressure increase of the drilling fluid surrounding the WDP string 120 in the well 102 that results in the drilling fluid flowing from the well 102 into and/or fracturing a subterranean formation 106 penetrated by the well 102. Controlling the drawworks 118 may also or instead comprise preventing the drawworks 118 from moving the WDP string 120 out of the well 102 at a speed sufficient to cause a pressure decrease of the drilling fluid surrounding the WDP string 120 in the well 102 that results in formation fluid flowing from the formation 106 into the well 102. Controlling the drawworks 118 may be further based on a mathematical model of properties of the drilling fluid surrounding the WDP string 120 in the well 102. The mathematical model may be generated by a processing device 400 of the surface wellsite equipment 310 based at least partially on the received downhole pressure data. Thus, the method may further comprise operating the processing device 400 to generate the mathematical model.

While performing the tripping operations, the method may further comprise controlling one or more portions of the tubular handling equipment or system 211, including the catwalk 161, the THM 160, the setback 166, and the iron roughneck 165. Controlling the tubular handling equipment may comprise slowing down or stopping the tubular handling equipment when the pressure of the drilling fluid surrounding the WDP string 120 results in: the drilling fluid flowing from the well 102 into a subterranean formation 106 penetrated by the well 102 (e.g., during a surge); the drilling fluid fracturing the subterranean formation 106 (e.g., during a surge); or formation fluid flowing from the subterranean formation 106 into the well 102 (e.g., during a swab).

Current control systems communicate with a rotary steering tool of a drill string via slow communication means, such as mud-pulse or electro-magnetic telemetry. Sensor data communicated via such telemetry means may take between about 30 and 60 seconds or longer to reach a wellsite surface to be analyzed by a surface equipment controller. Control data transmitted by the surface equipment controller may take about the same amount of time to reach the rotary steering tool. Such slow telemetry transmission rates prevent fast control of the rotary steering tool from the wellsite surface. However, an electrical conductor extending along the drill string (e.g., a WDP string) may be used to speed up downlink and uplink for a rotary steering tool, which may permit a fast control loop from the wellsite surface to facilitate tighter control of trajectory of the drill string.

Methods according to one or more aspects of the present disclosure may thus comprise, while performing drilling operations of an oil and gas well 102 via a drill string 120 comprising a rotary steering tool 334, generating downhole navigation sensor data indicative of trajectory of the drill string 120 via a downhole navigation sensor 186, transmitting the downhole navigation sensor data to an equipment controller (e.g., one or more of the equipment controllers 310) at a wellsite surface 104 via an electrical conductor 322 extending along the drill string 120. Such method may further comprise generating control data (i.e., control commands) for controlling trajectory of the drill string 120 by the equipment controllers 310 and transmitting the control data from the equipment controllers 310 to the rotary steering tool 334 via the electrical conductor 322 to control the trajectory of the drill string 120.

Methods may also comprise performing drilling operations in an oil and/or gas well with a WDP string 120 comprising a rotary steering tool 334, including causing operation of a processing device 400 of surface wellsite equipment (e.g., one or more of the equipment controllers 310) to transmit control data to the rotary steering tool 334 to thereby control trajectory of the WDP string 120. The control data may be transmitted from the surface wellsite equipment 310 to the rotary steering tool 334 via electrical conductor 322 integral to WDP 122 of the WDP string 120 and generated by the processing device 400. The control data may be generated by the processing device 400 based on downhole data that is generated by a downhole navigation sensor 186, indicative of the trajectory of the WDP string 120, and transmitted from the downhole navigation sensor 186 to the surface wellsite equipment 310 via the electrical conductor 322.

The control system 300 shown in FIG. 3 may comprise one or more features of the control system 200 shown in FIG. 2 and, thus, may perform one or more methods, operations, and/or processes of the control system 200 according to one or more aspects of the present disclosure. For example, one or more of the equipment controllers 310 (e.g., one or more of the equipment controllers 314, 316) of the control system 300 may comprise one or more features of the central controller 192 of the control system 200. Thus, one or more of the equipment controllers 310 may perform one or more methods, operations, and/or processes of the central controller 192 according to one or more aspects of the present disclosure.

Accordingly, the present disclosure is also directed to a control system 300 for controlling well construction equipment 116, 118, 144 operable to perform well construction operations to construct an oil and/or gas well 102 utilizing a WDP string 120 manipulated by the well construction equipment 116, 118, 144. The control system 300 may comprise a plurality of downhole sensors 186, 308 distributed axially along the WDP string 120, wherein each downhole sensor 186, 308 is operable to output downhole sensor data indicative of one or more downhole parameters during the well construction operations. The control system 300 may further comprise one or more equipment controllers 310 communicatively connected with the well construction equipment 116, 118, 144 and comprising a processing device 412 and a memory 416 storing an executable program code 432. The executable program code 432 may be executed by the processing device 412 to run a control process 250, which may cause the equipment controllers 310 to control the well construction equipment 116, 118, 144 and detect abnormal downhole events based on the downhole sensor data received from the downhole sensors 186, 308 via electrical conductors 322 integral to WDP 122 of the WDP string 120. The abnormal downhole events may comprise one or more of stick-slip, axial vibrations, lateral vibrations, rotational vibrations, stuck drill pipe, surge, swab, underpressure of formation fluid, and overpressure of formation fluid.

The well construction equipment 116, 118, 144 may comprise at least one of a mud pump 144 operable to pump drilling fluid, a drawworks 118 operable to raise and lower the WDP string 120 in the well 102, and a top drive 116 operable to rotate the WDP string 120. As described above, the downhole sensors 186, 308 may comprise at least one of rotational position sensors collectively operable to output rotational position data indicative of rotational orientation of the WDP string 120 at different depths in the well 102, rotational speed sensors collectively operable to output rotational speed data indicative of rotational speed of the WDP string 120 at different depths in the well 102, torque sensors collectively operable to output torque data indicative of torque transmitted through the WDP string 120 at different depths in the well 102, axial load sensors collectively operable to output axial load data indicative of axial load transmitted through the WDP string 120 at different depths in the well 102, accelerometers collectively operable to output acceleration data indicative of axial, lateral, rotational, and/or other acceleration (e.g., shock, oscillations, vibrations) experienced by the WDP string 120 at different depths in the well 102, pressure sensors collectively operable to output pressure data indicative of pressure of fluid surrounding the WDP string 120 at different depths in the well 102, and pressure sensors collectively operable to output pressure data indicative of pressure of drilling fluid flowing through the fluid pathway 121 of the WDP string 120 at different depths along the drill string 120.

The equipment controllers 310 may be further operable to output the received downhole sensor data and information indicative of the detected abnormal downhole events to a video output device 196 for display to a human driller 195. The equipment controllers 310 may be further operable to output the received downhole sensor data in association with corresponding depths in the well to a video output device 196 for display to a human driller 195. The control process 250 (i.e., the program code 432 executed by the processing device 412) may cause the equipment controllers 310 to, based on the received sensor data, determine one or more operations to be performed by the well construction equipment 116, 118, 144 that mitigate the detected abnormal downhole events. The control process 250 may also cause the equipment controllers 310 to output to a video output device 196 for display to a human driller information indicative of the determined operations to be performed by the well construction equipment 116, 118, 144, such that the human driller can cause the determined operations to be performed by the well construction equipment 116, 118, 144 to mitigate the detected abnormal downhole events.

The control process 250 may also or instead cause the equipment controllers 310 to control the well construction equipment 116, 118, 144 based on the downhole sensor data received from the downhole sensors 186, 308 via the electrical conductors 322. For example, the control process 250 may cause the equipment controllers 310 to, based on the received sensor data, select an operational sequence to be performed by the well construction equipment 116, 118, 144 to mitigate the detected abnormal downhole events, and output control data to operate the well construction equipment 116, 118, 144 to cause the selected operational sequence to be performed by the well construction equipment 116, 118, 144 to mitigate the detected abnormal downhole events.

The executable program code 432, when executed by a processing device 412, may cause the equipment controllers 310 to store a database 260 of operational sequences. A sequence selector 258 (i.e., the program code 432 executed by the processing device 412) may then select an operational sequence from the database 260 to be performed by the well construction equipment 116, 118, 144 that will mitigate the detected abnormal downhole events based on the received sensor data. The control process 250 may then output control data to operate the well construction equipment 116, 118, 144 to cause the selected operational sequence to be performed by the well construction equipment 116, 118, 144 to mitigate the detected abnormal downhole events.

The executable program code 432, when executed by the processing device 412, may cause the equipment controllers 310 to store a well construction plan 252 for constructing a well 102. Based on the received sensor data and the well construction plan 252, a sequence selector 258 may determine an operational sequence to be performed by the well construction equipment 116, 118, 144 to mitigate the detected abnormal downhole events. The control process 250 may then output control data to operate the well construction equipment 116, 118, 144 to cause the selected operational sequence to be performed by the well construction equipment 116, 118, 144 to mitigate the detected abnormal downhole events.

The following paragraphs describe several examples of the control system 300 shown in FIG. 3 performing monitoring and controlling operations of the well construction equipment 116, 118, 144 of the well construction system 100 shown in FIGS. 1 and 3 according to one or more aspects of the present disclosure. Accordingly, the following paragraphs refer to FIGS. 1 and 3, collectively.

During a tripping operational state of the well construction system 100, while the control process 250 is executing a planned operational sequence to trip a drill string from depth A to depth B, one or more of the equipment controllers 310 (e.g., one or more of the equipment controllers 314, 316) may receive sensor data from a downhole sensor 186 (e.g., an axial load sensor) transmitted to the surface via an electrical conductor 322 that indicates a sudden weight loss of the drill string 120. Based on such sensor data and operational state, the abnormal event detector 254 may detect that a bottom end of the drill string 120 encountered an obstruction, such as a downhole bridge. If no immediate action is taken, serious equipment damage, such as damage to the drill bit 126, the BHA 124, and/or the drill string 120 may occur. In a worst case, the well 102 may get lost. When such an abnormal event is detected, the operational sequence selector 258 may select an emergency shutdown operational sequence to the control process 250 or the local control process, which causes an immediate stop of the drawworks 118 to avoid the potential downhole failure. Thus, a bridge protection detection algorithm containing a predetermined operational sequence may be implemented directly within the one or more of the equipment controllers 310. Accordingly, when the sensor data indicates a sudden decrease in the weight of the drill string 120 during tripping in operational state, the one or more of the equipment controllers 310 may be operable to: detect that the drill string 120 contacted an obstruction within the wellbore 102; select a mitigating operational sequence to shut-down the drawworks 118; and output control data to cause the drawworks 118 to perform the mitigating operational sequence to shut down, thereby stopping operation of the drawworks 118.

Furthermore, during a drilling operational state of the well construction system 100, while the control process 250 is executing a planned operational sequence to drill the wellbore from depth A to depth B, one or more of the equipment controllers 310 (e.g., one or more of the equipment controllers 314, 316) may receive sensor data from downhole sensors 186, 308 (e.g., flow rate sensors, pressure sensors) transmitted to the surface via an electrical conductor 322 that indicate a sudden gain of return fluid flow. Based on such sensor data and operational state, the abnormal event detector 254 may detect that the wellbore 102 is experiencing a kick. Consequence of an uncontrollable kick can lead to environmental damage, or even a blowout. There are a number of predetermined operational sequences that can be performed depending on, for example, the severity of the kick, the well control procedure and available equipment and/or materials at the wellsite. One option to address abnormal fluid gain is to adjust drilling fluid density and to circulate out the kick. If this option is taken, the operational sequence may cause fluid management valves to automatically line up to switch to a different drilling fluid tank, or to perform on the fly a drilling fluid mixing sequence to change the drilling fluid density. Another option to address a kick can include initiating a well control sequence by first shutting-in the wellbore 102 and circulating the kick. The wellbore shut-in may include a number of operational sequences, such as raising the drilling string 120, stopping the mud pumps 144, and activating the well control equipment 130, 132, among other examples. After the well control sequence is selected by the operational sequence selector 258, the selected well control sequence may be passed to the control process 250 or the local control process and executed automatically without intervention by the rig personnel 195. Accordingly, when the sensor data indicates a sudden increase in the flow rate of the wellbore fluid flowing out of the wellbore 102 during the drilling operational state, the one or more of the equipment controllers 310 may be operable to: detect that the wellbore 102 is experiencing a kick; select an operational sequence to change density of drilling fluid or initiate a well control sequence; and output control data to cause drilling fluid mixing equipment 173 to perform the operational sequence to change the density of the drilling fluid thereby stopping the wellbore kick, or cause the well construction equipment and well control equipment 130, 132 to perform the well control sequence, thereby stopping and removing the wellbore kick.

Furthermore, during a tripping in operational state of the well construction system 100, while the control process 250 is executing a planned operational sequence to trip in the drill string 120 from depth A to depth B of the wellbore 102 following a pre-set tripping out speed, which may be depth dependent, one or more of the equipment controllers 310 (e.g., one or more of the equipment controllers 314, 316) receives sensor data from downhole sensors 186, 308 (e.g., flow rate sensors, pressure sensors) transmitted to the surface via an electrical conductor 322 that indicates a sudden gain of return fluid flow and/or increase of downhole wellbore pressure. Based on such sensor data and operational state, the abnormal event detector 254 may detect that the wellbore 102 is experiencing a surge. An increase in downhole wellbore pressure may lead to formation fracture and wellbore damage. Depending on the severity of the surge, there are a few mitigating operational sequences available overcome the surge. One mitigating operational sequence is to reduce the trip in speed. After a mitigating operational sequence is selected by the operational sequence selector 258, the selected mitigating operational sequence may be passed to the control process 250 or the local control process and executed automatically without intervention by the rig personnel. However, if the adjusted trip in speed cannot control the surge, further action can be taken, such as to stop the tripping in operations. Such predetermined mitigating operational sequences can be saved to the one or more of the equipment controllers 310 to ensure the secure and efficient execution of well construction operations without intervention by the rig personnel. Accordingly, when the sensor data indicates a sudden gain of return fluid flow and/or increase in the downhole pressure of the wellbore during the tripping in operational state, the one or more of the equipment controllers 310 may be operable to: detect that the wellbore is experiencing a wellbore surge; select an operational sequence to reduce a tripping in speed of the drawworks 118 or another mitigating operational sequence; and output control data to cause the drawworks 118 to perform the selected operational sequence, thereby stopping or reducing the surge.

Furthermore, during a tripping out operational state of the well construction system 100, while the control process 250 is executing a planned operational sequence to trip out the drill string 120 from depth B to depth A of the wellbore 102 following a pre-set tripping out speed, which may be depth dependent, one or more of the equipment controllers 310 (e.g., one or more of the equipment controllers 314, 316) receives sensor data from downhole sensors 186, 308 (e.g., flow rate sensors, pressure sensors) indicating a sudden loss or decrease of return fluid flow and/or decrease of downhole wellbore pressure. Based on such sensor data and operational state, the abnormal event detector 254 may detect that the wellbore is experiencing a swab. If the downhole wellbore pressure is reduced sufficiently, reservoir fluids may flow from the formation 106 into the wellbore 102 and towards the surface 104. Swabbing can lead to wellbore stability problems and kicks, which as described above, can lead to environmental damage or even a blowout. Depending on the severity of the swab, there are several mitigating operational sequences available to overcome a swab. One mitigating operational sequence is to reduce the trip out speed. After a mitigating operational sequence is selected by the operational sequence selector 258 to reduce the trip out speed, the selected mitigating operational sequence may be passed to the control process 250 or the local control process and executed automatically without intervention by rig personnel. In conjunction with slowing the trip out speed, fluid circulation may be included to fill in the wellbore 102 through the annulus to keep the wellbore 102 full or maintain a downhole pressure. However, if the adjusted trip out speed and/or fluid circulating into the annulus cannot control the swab, further action can be taken, such as to stop the trip out operations (i.e., stop the drawworks 118), and initiate a well control procedure. Such predetermined mitigating operational sequences can be saved to the one or more of the equipment controllers 310 to ensure the secure and efficient execution of well construction operations without intervention by the rig personnel. Accordingly, when the sensor data indicates a sudden decrease in downhole wellbore pressure during the tripping out operational state, the one or more of the equipment controllers 310 may be operable to: detect that the wellbore is experiencing a wellbore swab; select an operational sequence to reduce tripping out speed of the drawworks 118, increase fluid circulation into the annulus, and/or select another mitigating operational sequence; and output control data to cause the drawworks 118 and a corresponding pump 144 to perform the selected operational sequence, thereby stopping or reducing the swab.

Furthermore, during an operational state that comprises drilling with a mud motor 184, a risk of downhole failure could occur in the form of motor twist-off. During the mud motor drilling operation state, one or more of the equipment controllers 310 (e.g., one or more of the equipment controllers 314, 316) may receive sensor data from a sensor 186 (e.g., rotation sensor, position sensor) via an electrical conductor 322 indicating that the mud motor 184 is experiencing reverse rotation downhole (namely, instead of bit 126 rotating clockwise, the mud motor stator rotates counterclockwise). By using rotational speed measurements, which could be derived from magnetic and or gyroscopic measurements, mud motor reverse rotation can be detected. The downhome rotational speed sensor data and/or the occurrence of the mud motor reverse rotation can be transmitted to the surface 104 in real time via the electrical conductor 322. Based on such sensor data and operational state, the abnormal event detector 254 may detect that the wellbore 102 is experiencing stick-slip or bit stalling. The sequence selector 258 may then select a mitigating operational sequence based on the detected abnormal event and the operational state, including but not limited to, reduce or stop pumping operations, reduce WOB, and/or activate stick-slip mitigation control. After a mitigating operational sequence is selected by the operational sequence selector 258, the selected mitigating operational sequence may be passed to the control process 250 or the local control process and executed automatically without intervention by the rig personnel 195. Accordingly, when the sensor data indicates a reverse rotation of the mud motor 184 during mud motor drilling operational state, the one or more of the equipment controllers 310 may be operable to: detect a stuck drill bit 126 when the sensor data indicates reverse rotation of the mud motor 184; select an operational sequence to stop pumping drilling fluid, reduce WOB, or activate automatic drill bit rotation control; and output control data to cause a mud pump 144 to perform the operational sequence to stop pumping the drilling fluid thereby stopping the reverse rotation of the mud motor 184, cause the drawworks 118 to perform the operational sequence to reduce the WOB thereby stopping the reverse rotation of the mud motor 184, or cause the automatic drill bit rotation control to activate thereby stopping the reverse rotation of the mud motor 184.

Still further, when sensor data output by downhole sensors 186, 308 (e.g., pressure sensors that are in communication with a fluid passage 121 of the drill string 120) and transmitted to the surface via an electrical conductor 322 indicate a sudden decrease in the pressure of the drilling fluid being pumped into the drill string 120 during drilling operations, one or more of the equipment controllers 310 (e.g., one or more of the equipment controllers 314, 316) may be operable to: detect that the drill string 120 is experiencing a drilling fluid leak; select an operational sequence to reduce flow rate of the drilling fluid being pumped into the drill string 120, or stop the drilling operations; and output control data to cause a mud pump 144 to perform the operational sequence to reduce the flow rate of the drilling fluid being pumped into the drill string 120, or cause the well construction equipment 116, 118, 144 to perform the operational sequence to stop the drilling operations.

Also, when sensor data output by downhole sensors 186, 308 (e.g., orientation sensors, position sensors, rotation sensors) and transmitted to the surface via an electrical conductor 322 indicates that a motor toolface 185 is not oriented as intended during drilling operations, one or more of the equipment controllers 310 (e.g., one or more of the equipment controllers 314, 316) may be operable to: select an operational sequence to rotate a top drive 116, change oscillation characteristics of the top drive 116, or change WOB; and output control data to cause the top drive 116 to perform the operational sequence to rotate the top drive 116 thereby changing the orientation of the motor toolface 185 to an intended motor toolface orientation, cause the top drive 116 to perform the operational sequence to change the oscillation characteristics of the top drive 116 thereby changing the orientation of the motor toolface 185 to an intended motor toolface orientation, or cause a drawworks 118 to perform the operational sequence to change the WOB thereby changing the orientation of the motor toolface 185 to an intended motor toolface orientation.

In view of the entirety of the present disclosure, including the figures and the claims, a person having ordinary skill in the art will readily recognize that the present disclosure introduces a method comprising performing slide drilling operations with a WDP string in an oil and/or gas well, including imparting rotational oscillations to the WDP string by controlling a top drive based on downhole data received by wellsite surface equipment via electrical conductors integral to WDP of the WDP string, wherein the received downhole data comprises downhole rotational orientation data that is: generated by a plurality of rotation sensors distributed axially along the WDP string; and indicative of rotational orientation of different sections of the WDP string.

The downhole rotational orientation data may also be indicative of rotational orientation of a toolface of a mud motor of the WDP string. In such implementations, among others within the scope of the present disclosure, controlling the top drive may comprise maximizing rotational oscillations imparted to the WDP string while minimizing rotational oscillations of the mud motor toolface.

The different sections of the WDP string may be different first sections of the WDP string. In such implementations, among others within the scope of the present disclosure, the received downhole data may further comprise downhole torque data that is: generated by a plurality of torque sensors distributed axially along the WDP string; and indicative of torque transmitted through the different first sections and/or different second sections of the WDP string.

The received downhole data may be received first downhole data, and performing the slide drilling operations may further include vertically moving the WDP string by controlling a drawworks based on second downhole data received by the wellsite surface equipment via the electrical conductors. The received second downhole data may comprise downhole axial load data that is: generated downhole by an axial load sensor; and indicative of axial load applied to a drill bit of the WDP string.

The present disclosure also introduces a method comprising performing drilling operations with a WDP string in an oil and/or gas well, including pumping drilling fluid to a mud motor of the WDP string through an internal passage of the WDP string and vertically moving the WDP string via a drawworks while controlling the drawworks to change the speed of the WDP string based on downhole data received by wellsite surface equipment via electrical conductors integral to WDP of the WDP string, wherein the received downhole data comprises downhole pressure data that is generated downhole by a pressure sensor and is indicative of pressure of the drilling fluid in the internal passage.

Controlling the drawworks to change speed of the WDP string may be further based on information that is determined by the wellsite surface equipment based on downhole data received by the wellsite surface equipment via electrical conductors integral to WDP of the WDP string. In such implementations, among others within the scope of the present disclosure, the determined information may comprise torque at a drill bit of the WDP string.

The received downhole data may be received first downhole data, performing the drilling operations may further include controlling the drawworks to change the speed of the WDP string based on second downhole data received by the wellsite surface equipment via the electrical conductors, and the received second downhole data may comprise downhole axial load data that is generated downhole by an axial load sensor and indicative of axial load applied to a drill bit of the WDP string.

The pressure sensor may be either disposed within a BHA of the WDP string or connected with a WDP section of the WDP string.

The present disclosure also introduces a method comprising performing slide drilling operations with a WDP string in an oil and/or gas well, including imparting rotational oscillations to the WDP string by controlling a top drive based on: (A) downhole rotational orientation data that is: (i) generated by rotation sensors distributed axially along the WDP string; (ii) indicative of rotational orientation of different first sections of the WDP string; and (iii) received by wellsite surface equipment via electrical conductors integral to WDP of the WDP string; and (B) a mathematical model of a downhole system generated by the wellsite surface equipment based at least partially on the received downhole rotational orientation data and downhole torque data that is: (i) generated by torque sensors distributed axially along the WDP string; (ii) indicative of torque transmitted through the different first sections and/or different second sections of the WDP string; and (iii) received by the wellsite surface equipment via the electrical conductors.

The downhole system may comprise at least one of the WDP string, a sidewall of the well, and wellbore fluid between the sidewall and the WDP string.

The mathematical model may describe properties at different axial locations along the WDP string. In such implementations, among others within the scope of the present disclosure, the properties may comprise at least one of: mechanical properties of the WDP string; friction properties between the wellbore fluid and the WDP string; and friction properties between the sidewall and the WDP string.

The downhole rotational orientation sensor data may be indicative of rotational orientation of a plurality of WDP sections of the WDP string and rotational orientation of a mud motor toolface of the WDP string. In such implementations, among others within the scope of the present disclosure, controlling the top drive may comprise controlling the top drive to maximize the imparted rotational oscillations while minimizing rotational oscillations of the mud motor toolface.

The present disclosure also introduces a method comprising performing drilling operations with a WDP string in an oil and/or gas well, including vertically moving the WDP string by controlling a drawworks based on downhole data received by wellsite surface equipment via electrical conductors integral to WDP of the WDP string, wherein the received downhole data comprises downhole axial load data that is: generated downhole by an axial load sensor; and indicative of axial load applied to a drill bit of the WDP string.

The received downhole data may be received first downhole data, controlling the drawworks may be further based on second downhole data received by the wellsite surface equipment via the electrical conductors, and the received second downhole data may be: generated downhole by a torque sensor; and indicative of torque at a drill bit of the WDP string.

The received downhole data may be received first downhole data, controlling the drawworks may be further based on second downhole data received by the wellsite surface equipment via the electrical conductors, and the received second downhole data may be generated downhole by a pressure sensor. The received second downhole data may be indicative of pressure of drilling fluid in an internal passage of the WDP string. Controlling the drawworks based on the received second downhole data may comprise controlling the drawworks based on torque at a drill bit of the WDP string, wherein the torque may be determined by the wellsite surface equipment based on the received second downhole data.

The present disclosure also introduces a method comprising performing drilling operations in an oil and/or gas well with a WDP string that is experiencing stick-slip, including reducing the stick-slip by controlling a top drive based on downhole data received by wellsite surface equipment via electrical conductors integral to WDP of the WDP string, wherein the received downhole data comprises downhole rotational speed data that is: generated by a plurality of rotation sensors distributed axially along the WDP string; and indicative of rotational speed of different sections of the WDP string.

Controlling the top drive to reduce the stick-slip may be further based on information determined by the wellsite surface equipment. In such implementations, among others within the scope of the present disclosure, the determined information may comprise frequency of the stick-slip determined based on the received downhole rotational speed data.

Controlling the top drive to reduce the stick-slip may be further based on information determined by the wellsite surface equipment. In such implementations, among others within the scope of the present disclosure, the determined information may comprise an amount of time for a rotational oscillation of the stick-slip to propagate to the top drive based on the received downhole rotational speed data. Controlling the top drive may dampen the rotational oscillation of the stick-slip.

The present disclosure also introduces a method comprising performing drilling operations with a WDP string in an oil and/or gas well, including pumping drilling fluid through an internal passage of the WDP string by controlling mud pumps based on downhole data received by wellsite surface equipment via electrical conductors integral to WDP of the WDP string, wherein: (A) the received downhole data comprises wellbore pressure data that is: (i) generated by a plurality of pressure sensors distributed axially along the WDP string; and (ii) indicative of pressure of wellbore fluid outside the WDP string; and (B) controlling the mud pumps maintains the wellbore fluid outside the WDP string at an intended pressure.

Controlling the mud pumps may be further based on a mathematical model of wellbore fluid properties along the well. In such implementations, among others within the scope of the present disclosure, the model may be generated by the wellsite surface equipment based at least partially on the received wellbore pressure data. The mathematical model may describe wellbore fluid pressure distribution along the well.

The present disclosure also introduces a method comprising performing drilling operations with a WDP string in an oil and/or gas well, including controlling drilling equipment to control the drilling operations based on: (A) downhole data received by wellsite surface equipment via electrical conductors integral to WDP of the WDP string; and (B) a mathematical model of a downhole system, wherein: (i) the received downhole data is indicative of downhole properties and is generated by a plurality of sensors distributed axially along the WDP string; and (ii) the model is generated by a processing system of the well site surface equipment based at least partially on the received downhole data.

The downhole system may comprise at least one of: the WDP string; drilling fluid within the WDP string; physical properties of the well; and wellbore fluid surrounding the WDP string in the well.

The mathematical model may describe at least one of: axial load distribution along the WDP string; torque distribution along the WDP string; rotational speed distribution along the WDP string; pressure distribution of drilling fluid within the WDP string; pressure distribution of wellbore fluid surrounding the WDP string in the well; and distribution of friction properties affecting the WDP string.

The received downhole data may comprise at least one of: downhole axial load data indicative of axial load transmitted by the WDP string; downhole torque data indicative of torque transmitted by the WDP string; downhole rotational orientation WDP data indicative of rotational orientation of the WDP string; downhole rotational speed data indicative of rotational speed of the WDP string; downhole pressure data indicative of pressure of wellbore fluid surrounding the WDP string; and downhole pressure sensor indicative of pressure of drilling fluid inside the WDP string.

The present disclosure also introduces a method comprising performing drilling operations with a WDP string in an oil and/or gas well, including: (A) pumping drilling fluid through an internal passage of the WDP string while wellsite surface equipment receives downhole data via electrical conductors integral to WDP of the WDP string, wherein the received downhole data comprises downhole pressure data that is: (i) generated by a plurality of pressure sensors distributed axially along the WDP string; and (ii) indicative of pressure of the drilling fluid surrounding the WDP string in the well; and (B) operating a processing device of the wellsite surface equipment to detect a narrow portion of the well based on the received downhole pressure data.

Detecting the narrow portion may comprise detecting a well depth at which the received downhole pressure data is indicative of a lower pressure relative to pressure at other portions of the well. In such implementations, among others within the scope of the present disclosure, the narrow portion may be located at the detected well depth.

Detecting the narrow portion may comprise detecting a well depth at which the received downhole pressure data is indicative of a lower pressure relative to pressure at other portions of the well.

Detecting the narrow portion may comprise detecting a well depth at which the received downhole pressure data is indicative of a higher equivalent circulating density relative to equivalent circulating density at other portions of the well. The narrow portion may be located at the detected well depth.

The present disclosure also introduces a method comprising performing tripping operations with a WDP string within an oil and/or gas well, including moving the WDP string within the well by controlling a drawworks based on downhole data received by wellsite surface equipment via electrical conductors integral to WDP of the WDP string, wherein the received downhole data comprises downhole pressure data that is: generated by a plurality of pressure sensors distributed axially along the WDP string; and indicative of pressure of drilling fluid surrounding the WDP string in the well.

Controlling the drawworks may be further based on a mathematical model of properties of the drilling fluid surrounding the WDP string in the well, and the mathematical model may be generated by a processing device of the wellsite surface equipment based at least partially on the received downhole pressure data. The method may further comprise operating the processing device to generate the mathematical model.

Controlling the drawworks may comprise at least one of: preventing the drawworks from moving the WDP string into the well at a speed sufficient to cause a pressure increase of the drilling fluid surrounding the WDP string in the well that results in the drilling fluid flowing from the well into and/or fracturing a subterranean formation penetrated by the well; and preventing the drawworks from moving the WDP string out of the well at a speed sufficient to cause a pressure decrease of the drilling fluid surrounding the WDP string in the well that results in formation fluid flowing from the subterranean formation into the well.

The method may further comprise controlling tubular handling equipment based on the downhole data. Controlling the tubular handling equipment may comprise slowing down or stopping the tubular handling equipment when the pressure of the drilling fluid surrounding the WDP string results in: the drilling fluid flowing from the well into a subterranean formation penetrated by the well; the drilling fluid fracturing the subterranean formation; or formation fluid flowing from the subterranean formation into the well.

The present disclosure also introduces a method comprising performing drilling operations in an oil and/or gas well with a WDP string comprising a rotary steering tool, including causing operation of a processing device of wellsite surface equipment to transmit control commands to the rotary steering tool to thereby control trajectory of the WDP string, wherein the control commands are: (A) transmitted from the wellsite surface equipment to the rotary steering tool via electrical conductors integral to WDP of the WDP string; and (B) generated by the processing device based on downhole data that is: (i) generated by a downhole navigation sensor; (ii) indicative of the trajectory of the WDP string; and (iii) transmitted from the downhole navigation sensor to the wellsite surface equipment via the electrical conductors.

The present disclosure also introduces an apparatus comprising a control system for controlling well construction equipment operable to perform well construction operations to construct an oil and/or gas well utilizing a WDP string manipulated by well construction equipment, wherein the control system comprises: (A) a plurality of downhole sensors distributed axially along the WDP string, wherein each downhole sensor is operable to output downhole sensor data indicative of one or more downhole parameters during the well construction operations; and (B) an equipment controller communicatively connected with the well construction equipment and comprising a processing device and a memory storing executable program code that, when executed by the processing device, causes the equipment controller to: (i) make a determination based on at least the downhole sensor data received from the downhole sensors via electrical conductors integral to WDP of the WDP string; and (ii) control the well construction equipment based on the determination. Making the determination may comprise at least one of: determining, based on the received downhole sensor data and a predetermined well construction plan, an operational sequence to be performed by the well construction equipment; and/or detecting an abnormal downhole event based on at least the received downhole sensor data.

The executable program code, when executed by the processing device, may cause the equipment controller to: determine the operational sequence; detect the abnormal downhole event; and output control data that is based on the determined operational sequence and the detected abnormal downhole event, wherein the control data is to operate the well construction equipment to cause the determined operational sequence to be performed by the well construction equipment to mitigate the detected abnormal downhole event.

The executable program code, when executed by the processing device, may cause the equipment controller to output information indicative of the made determination to a video output device for display to a human driller.

The executable program code, when executed by the processing device, may cause the equipment controller to output, to the video output device, a portion of the received downhole sensor data on which the made determination was based.

The present disclosure also introduces an apparatus comprising a control system for controlling well construction equipment operable to perform well construction operations to construct an oil and/or gas well utilizing a WDP string manipulated by the well construction equipment, wherein the control system comprises: (A) a plurality of downhole sensors distributed axially along the WDP string, wherein each downhole sensor is operable to output downhole sensor data indicative of one or more downhole parameters during the well construction operations; and (B) an equipment controller communicatively connected with the well construction equipment and comprising a processing device and a memory storing executable program code that, when executed by the processing device, causes the equipment controller to: (i) control the well construction equipment; and (ii) detect abnormal downhole events based on the downhole sensor data received from the downhole sensors via electrical conductors integral to WDP of the WDP string.

The executable program code, when executed by the processing device, may cause the equipment controller to control the well construction equipment based on the received downhole sensor data.

The well construction equipment may comprise at least one of: a mud pump operable to pump drilling fluid; a drawworks operable to raise and lower the WDP string in the well; a top drive operable to rotate the WDP string; and a choke manifold.

The downhole sensors may comprise rotational position sensors collectively operable to output rotational position data indicative of rotational orientation of the WDP string at different depths in the well.

The downhole sensors may comprise rotational speed sensors collectively operable to output rotational speed data indicative of rotational speed of the WDP string at different depths in the well.

The downhole sensors may comprise torque sensors collectively operable to output torque data indicative of torque transmitted through the WDP string at different depths in the well.

The downhole sensors may comprise axial load sensors collectively operable to output axial load data indicative of axial load transmitted through the WDP string at different depths in the well.

The downhole sensors may comprise pressure sensors collectively operable to output pressure data indicative of pressure of fluid surrounding the WDP string at different depths in the well.

The equipment controller may be operable to output the received downhole sensor data and information indicative of the detected abnormal downhole events to a video output device for display to a human driller.

The equipment controller may be operable to output the received downhole sensor data in association with corresponding depths in the well to a video output device for display to a human driller.

The abnormal downhole events may include one or more of stick-slip, axial vibrations, lateral vibrations, rotational vibrations, stuck drill pipe, swab, surge, underpressure of formation fluid, and overpressure of formation fluid.

The executable program code, when executed by the processing device, may cause the equipment controller to: based on the received sensor data, determine operations to be performed by the well construction equipment that mitigates one of the detected abnormal downhole events; and output, to a video output device for display to a human driller, information indicative of the determined operations to be performed by the well construction equipment such that the human driller can cause the determined operations to be performed by the well construction equipment to mitigate the one of the detected abnormal downhole events.

The executable program code, when executed by the processing device, may cause the equipment controller to: based on the received sensor data, select an operational sequence to be performed by the well construction equipment to mitigate one of the detected abnormal downhole events; and output control data to operate the well construction equipment to cause the selected operational sequence to be performed by the well construction equipment to mitigate the one of the detected abnormal downhole events.

The executable program code, when executed by the processing device, may cause the equipment controller to: store a database of operational sequences; based on the received sensor data, select an operational sequence from the database to be performed by the well construction equipment that will mitigate one of the detected abnormal downhole events; and output control data to operate the well construction equipment to cause the selected operational sequence to be performed by the well construction equipment to mitigate the one of the detected abnormal downhole events.

The executable program code, when executed by the processing device, may cause the equipment controller to: store a well construction plan for constructing a well; based on the received sensor data and the well construction plan, determine an operational sequence to be performed by the well construction equipment to mitigate one of the detected abnormal downhole events; and output control data to operate the well construction equipment to cause the selected operational sequence to be performed by the well construction equipment to mitigate the one of the detected abnormal downhole events.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. A method comprising:

performing slide drilling operations with a wired drill pipe (WDP) string in an oil and/or gas well, wherein performing the slide drilling operations comprises:

imparting rotational oscillations to the WDP string by controlling a top drive based on at least a first portion of downhole data received by wellsite surface equipment via electrical conductors integral to WDP of the WDP string, wherein the at least first portion of the received downhole data comprises:

downhole rotational orientation data generated by a plurality of rotation sensors distributed axially along the WDP string, wherein the downhole rotational orientation data is indicative of rotational orientation of different sections of the WDP string and a toolface of a mud motor of the WDP string; and downhole torque data generated by a plurality of torque sensors distributed axially along the WDP string, wherein the downhole torque data is indicative of torque transmitted through the different sections of the WDP string;

vertically moving the WDP string by controlling a drawworks based on at least a second portion of the received downhole data, wherein the at least second portion of the received downhole data comprises one or more of:

the downhole torque data; and downhole axial load data generated by an axial load sensor of a bottom-hole assembly (BHA) of the WDP string, wherein the downhole axial load data is indicative of an axial load applied to a drill bit of the WDP string; and pumping drilling fluid through an internal passage of the WDP string by controlling a plurality of mud pumps based on at least a third portion of the received downhole data;

the at least third portion of the received downhole data comprises downhole pressure data generated by a pressure sensor of the BHA; and the downhole pressure data is indicative of pressure of the drilling fluid in the internal passage of the WDP string;

wherein controlling the plurality of mud pumps is based on torque at the drill bit (TAB), and wherein the TAB is determined based on the downhole pressure data.

2. The method of claim 1 wherein:

imparting rotational oscillations to the WDP string by controlling the top drive comprises maximizing rotational oscillations imparted to the WDP string while minimizing rotational oscillations of the mud motor toolface.

3. The method of claim 1 wherein:

performing the slide drilling operations further comprises receiving the downhole rotational orientation data and the downhole torque data at the wellsite surface equipment via the electrical conductors of the WDP string and repeater subs connected between joints of the WDP string; and none of the repeater subs comprise any of the rotation sensors and the torque sensors.

4. The method of claim 1 wherein:

performing the slide drilling operations further comprises operating a processing device of the wellsite surface equipment to generate a mathematical model of a downhole system based at least partially on the downhole rotational orientation data and the downhole torque data; and controlling the top drive to impart rotational oscillations to the WDP string is based on the downhole rotational orientation data and the generated mathematical model.

5. The method of claim 4 wherein the downhole system comprises the WDP string, a sidewall of a well being formed by the slide drilling operations, and wellbore fluid between the sidewall and the WDP string.

6. The method of claim 5 wherein the mathematical model describes properties at different axial locations along the WDP string.

7. The method of claim 6 wherein the properties comprise mechanical properties of the WDP string, friction properties between the wellbore fluid and the WDP string, and friction properties between the sidewall and the WDP string.

8. A method comprising:

performing slide drilling operations with a wired drill pipe (WDP) string in an oil and/or gas well, wherein performing the slide drilling operations comprises:

imparting rotational oscillations to the WDP string by controlling a top drive based on at least a first portion of downhole data received by wellsite surface equipment via electrical conductors integral to WDP of the WDP string, wherein the at least first portion of the received downhole data comprises:

downhole rotational orientation data generated by a plurality of rotation sensors distributed axially along the WDP string, wherein the downhole rotational orientation data is indicative of rotational orientation of different sections of the WDP string and a toolface of a mud motor of the WDP string; and downhole torque data generated by a plurality of torque sensors distributed axially along the WDP string, wherein the downhole torque data is indicative of torque transmitted through the different sections of the WDP string;

vertically moving the WDP string by controlling a drawworks based on at least a second portion of the received downhole data, wherein the at least second portion of the received downhole data comprises one or more of:

the downhole torque data; and downhole axial load data generated by an axial load sensor of a bottom-hole assembly (BHA) of the WDP string, wherein the downhole axial load data is indicative of an axial load applied to a drill bit of the WDP string; and pumping drilling fluid through an internal passage of the WDP string by controlling a plurality of mud pumps based on at least a third portion of the received downhole data;

the at least third portion of the received downhole data comprises downhole pressure data generated by a pressure sensor of the BHA; and the downhole pressure data is indicative of pressure of the drilling fluid in the internal passage of the WDP string;

wherein controlling the drawworks comprises controlling a rotational speed of the drawworks based on at least one of:

the downhole pressure data; and torque at the drill bit (TAB), wherein the TAB is determined based on the downhole pressure data.

9. The method of claim 8 wherein:

imparting rotational oscillations to the WDP string by controlling the top drive comprises maximizing rotational oscillations imparted to the WDP string while minimizing rotational oscillations of the mud motor toolface.

10. The method of claim 8 wherein:

performing the slide drilling operations further comprises receiving the downhole rotational orientation data and the downhole torque data at the wellsite surface equipment via the electrical conductors of the WDP string and repeater subs connected between joints of the WDP string; and none of the repeater subs comprise any of the rotation sensors and the torque sensors.

11. A method comprising:

performing slide drilling operations with a wired drill pipe (WDP) string in an oil and/or gas well, wherein performing the slide drilling operations comprises:

imparting rotational oscillations to the WDP string by controlling a top drive based on at least a first portion of downhole data received by wellsite surface equipment via electrical conductors integral to WDP of the WDP string, wherein the at least first portion of the received downhole data comprises:

downhole rotational orientation data generated by a plurality of rotation sensors distributed axially along the WDP string, wherein the downhole rotational orientation data is indicative of rotational orientation of different sections of the WDP string and a toolface of a mud motor of the WDP string; and downhole torque data generated by a plurality of torque sensors distributed axially along the WDP string, wherein the downhole torque data is indicative of torque transmitted through the different sections of the WDP string;

vertically moving the WDP string by controlling a drawworks based on at least a second portion of the received downhole data, wherein the at least second portion of the received downhole data comprises one or more of:

the downhole torque data; and downhole axial load data generated by an axial load sensor of a bottom-hole assembly (BHA) of the WDP string, wherein the downhole axial load data is indicative of an axial load applied to a drill bit of the WDP string;

pumping drilling fluid through an internal passage of the WDP string by controlling a plurality of mud pumps based on at least a third portion of the received downhole data;

the at least third portion of the received downhole data comprises downhole pressure data generated by a pressure sensor of the BHA; and the downhole pressure data is indicative of pressure of the drilling fluid in the internal passage of the WDP string; and detecting a presence and location of a narrow portion of a wellbore being formed by the slide drilling operations based on at least a fourth portion of the received downhole data;

the at least fourth portion of the received downhole data comprises annular wellbore pressure data generated by a plurality of annular wellbore pressure sensors distributed axially along the WDP string; and the annular wellbore pressure data is indicative of pressure of wellbore fluid surrounding the WDP string in the wellbore.

12. The method of claim 11 wherein:

performing the slide drilling operations further comprises receiving the downhole rotational orientation data, the downhole torque data, and the annular wellbore pressure data at the well site surface equipment via the electrical conductors of the WDP string and repeater subs connected between joints of the WDP string; and none of the repeater subs comprise any of the rotation sensors, the torque sensors, and the annular wellbore pressure sensors.

13. The method of claim 11 wherein detecting the presence and the location of the narrow portion comprises detecting a well depth at which the annular wellbore pressure data is indicative of a lower annular wellbore pressure relative to annular wellbore pressure at other portions of the well.

14. The method of claim 11 wherein at least one of controlling the top drive, controlling the drawworks, and controlling the plurality of mud pumps is further based on the detected narrow portion.

15. The method of claim 11 wherein controlling the top drive, controlling the drawworks, and controlling the plurality of mud pumps are each further based on the detected narrow portion.

16. The method of claim 11 wherein:

imparting rotational oscillations to the WDP string by controlling the top drive comprises maximizing rotational oscillations imparted to the WDP string while minimizing rotational oscillations of the mud motor toolface.

17. A method comprising:

performing slide drilling operations with a wired drill pipe (WDP) string in an oil and/or gas well, wherein performing the slide drilling operations comprises:

imparting rotational oscillations to the WDP string by controlling a top drive based on at least a first portion of downhole data received by wellsite surface equipment via electrical conductors integral to WDP of the WDP string, wherein the at least first portion of the received downhole data comprises:

downhole rotational orientation data generated by a plurality of rotation sensors distributed axially along the WDP string, wherein the downhole rotational orientation data is indicative of rotational orientation of different sections of the WDP string and a toolface of a mud motor of the WDP string; and downhole torque data generated by a plurality of torque sensors distributed axially along the WDP string, wherein the downhole torque data is indicative of torque transmitted through the different sections of the WDP string;

vertically moving the WDP string by controlling a drawworks based on at least a second portion of the received downhole data, wherein the at least second portion of the received downhole data comprises one or more of:

the downhole torque data; and downhole axial load data generated by an axial load sensor of a bottom-hole assembly (BHA) of the WDP string, wherein the downhole axial load data is indicative of an axial load applied to a drill bit of the WDP string; and operating a processing device of wellsite surface equipment to generate a mathematical model of a downhole system based at least partially on the downhole rotational orientation data and the downhole torque data;

wherein controlling the top drive to impart rotational oscillations to the WDP string is based on the downhole rotational orientation data and the generated mathematical model;

wherein the downhole system comprises the WDP string, a sidewall of a well being formed by the slide drilling operations, and wellbore fluid between the sidewall and the WDP string;

wherein the mathematical model describes properties at different axial locations along the WDP string;

wherein the properties comprise mechanical properties of the WDP string, friction properties between the wellbore fluid and the WDP string, and friction properties between the sidewall and the WDP string; and wherein controlling the drawworks:

is further based on the mathematical model; and further comprises preventing the drawworks from moving the WDP string into the well at a speed sufficient to cause a pressure increase of the wellbore fluid surrounding the WDP string in the well that results in fracturing a subterranean formation penetrated by the well.

18. The method of claim 17 wherein controlling the drawworks further comprises preventing the drawworks from moving the WDP string out of the well at a speed sufficient to cause a pressure decrease of the wellbore fluid surrounding the WDP string in the well that results in formation fluid flowing from the formation into the well.

19. The method of claim 17 wherein:

imparting rotational oscillations to the WDP string by controlling the top drive comprises maximizing rotational oscillations imparted to the WDP string while minimizing rotational oscillations of the mud motor toolface.

20. The method of claim 17 wherein:

performing the slide drilling operations further comprises receiving the downhole rotational orientation data and the downhole torque data at the wellsite surface equipment via the electrical conductors of the WDP string and repeater subs connected between joints of the WDP string; and none of the repeater subs comprise any of the rotation sensors and the torque sensors.

* * * * *